United States Patent [19]

Kubo et al.

[11] 4,225,083

[45] * Sep. 30, 1980

[54] APPARATUS FOR APPLYING REFRACTORY MATERIAL ONTO THE INNER SURFACE OF A FURNACE

[75] Inventors: Sueki Kubo; Toshiro Watanabe; Masayuki Fujita; Tadahiko Matsuno, all of Kitakyushu; Akira Morita, Ibaragi, all of Japan

[73] Assignee: Kurosaki Refractories Co., Ltd., Kitakyushu, Japan

[ * ] Notice: The portion of the term of this patent subsequent to Oct. 17, 1995, has been disclaimed.

[21] Appl. No.: 912,903

[22] Filed: Jun. 5, 1978

Related U.S. Application Data

[63] Continuation-in-part of Ser. No. 788,941, Apr. 19, 1977, Pat. No. 4,120,260.

[30] Foreign Application Priority Data

| | | | |
|---|---|---|---|
| Apr. 19, 1976 | [JP] | Japan | 51-44759 |
| Nov. 12, 1976 | [JP] | Japan | 51-136733 |
| Nov. 16, 1976 | [JP] | Japan | 51-154018[U] |
| Nov. 24, 1976 | [JP] | Japan | 51-141422 |
| Dec. 1, 1976 | [JP] | Japan | 51-161518[U] |
| Dec. 3, 1976 | [JP] | Japan | 51-145757 |
| Dec. 3, 1976 | [JP] | Japan | 51-162941[U] |
| Dec. 8, 1976 | [JP] | Japan | 51-148048 |
| Dec. 23, 1976 | [JP] | Japan | 51-173401[U] |
| Jan. 20, 1977 | [JP] | Japan | 52-6182[U] |
| Feb. 7, 1977 | [JP] | Japan | 52-12679 |
| Feb. 15, 1977 | [JP] | Japan | 52-17727[U] |
| Mar. 28, 1977 | [JP] | Japan | 52-38147[U] |

[51] Int. Cl.[2] ..... B05B 3/12; B05B 15/00

[52] U.S. Cl. ..... 239/132.3; 239/172; 239/187; 239/227

[58] Field of Search ..... 239/184, 186, 187, 165, 239/142, 588, 172, 132.3; 137/599; 222/527; 366/142; 266/281

[56] References Cited

U.S. PATENT DOCUMENTS

| | | | |
|---|---|---|---|
| 1,512,581 | 10/1924 | Deming | 239/588 X |
| 3,010,316 | 11/1961 | Snyder | 137/599 X |
| 3,351,289 | 11/1967 | Demaison | 239/187 X |
| 3,602,394 | 8/1971 | McCune | 239/142 |
| 3,827,633 | 8/1974 | Kouno et al. | 239/187 |
| 3,917,170 | 11/1975 | Marino | 239/165 |
| 3,957,203 | 5/1976 | Bullard | 239/165 X |
| 3,991,984 | 11/1976 | Porter | 366/142 |
| 4,106,760 | 8/1978 | Kono | 266/281 |
| 4,120,260 | 10/1978 | Kubo et al. | 239/187 |

*Primary Examiner*—James L. Rowland
*Attorney, Agent, or Firm*—Jordan and Hamburg

[57] ABSTRACT

Refractory material in wet slurry form is applied onto the inner surface of a furnace. The improvement is characterized in that the water to be added into the powder-like refractory material for producing the above slurry refractory material is finely and accurately regulated so that the resultant refractory material sprayed from the spray nozzle fixedly adheres onto the abraded or eroded portion of the inner surface of the furnace with a minimum amount of rebound loss.

4 Claims, 56 Drawing Figures

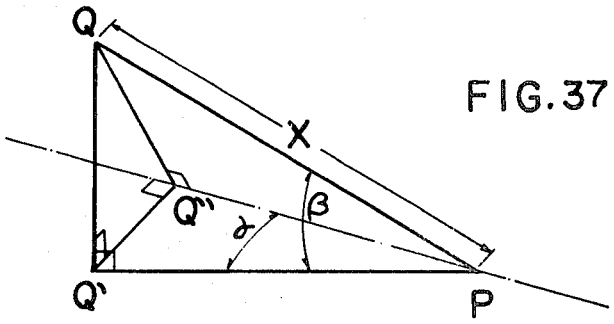
FIG. 37
FIG. 38
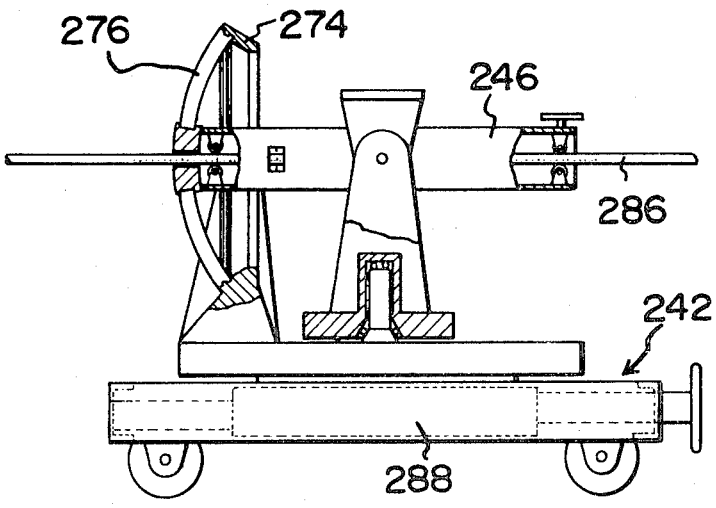

APPARATUS FOR APPLYING REFRACTORY MATERIAL ONTO THE INNER SURFACE OF A FURNACE

This application is a continuation-in-part of application Ser. No. 788,941, filed Apr. 19, 1977, now U.S. Pat. No. 4,120,260.

BACKGROUND OF THE INVENTION

The invention relates to an apparatus for applying a lining of refractory material, cement, heat insulating material and other insulating materials over the refractory layers of a converter or a furnace including an electric furnace and an open-hearth furnace or a vessel with a great reliability.

In conventional lining operations, the lining material is produced away from the lining operation site and then is transferred to the operation site by means of a long compression supply tube wherein the long floor-laid tube hampers the movement of the lining device when it must move from one converter to another, resulting in an inefficient lining operation.

Furthermore, since the water storage tank, refractory material tank, compressor and the like which are required in the lining operation occupy a large floor area, the operation cannot be conducted efficiently or with adequate mobility.

In addition, these devices are installed apart from each other so that a central control system for the spraying apparatus is hard to achieve. Therefore, at least several workers are required to operate the apparatus.

Meanwhile, in the lining operation, the lining apparatus is moved to a position adjacent to the upper open end of the furnace. Subsequently, the long shooting pipe is extended into the furnace and then the spray nozzle attached to the extremity of the shooting pipe is directed toward the abraded or eroded portion of the furnace lining and the desired amount of refractory material is sprayed onto the above portion so as to repair the lining of a furnace.

In this case, the operator controls the shooting pipe while observing the movement thereof.

However, the mere manipulation of the shooting pipe cannot cover some of the abraded portions on the furnace lining because they are not within the sprayable range of the shooting pipe.

For example, when the spray nozzle is directed from one abraded portion to another, in some cases, the shooting pipe will come into contact with the upper periphery of the furnace if the lining apparatus is kept in the same position. In these cases, the apparatus as a whole must be moved a certain distance to prevent breaking the shooting pipe. The operation to move the apparatus conventionally requires the operator to get off the apparatus or shift his position on the apparatus thereby making the operation very cumbersome.

The applicant of this application has previously disclosed a lining apparatus which can resolve the aforementioned problems in U.S. Pat. No. 3,827,633 (registered on Aug. 6, 1974).

However, the above lining apparatus is less than optimal in view of the following aspects.

(1) In the lining operation by the conventional apparatuses including the above improved apparatus, the refractory material in wet slurry form, which is produced by mixing the powder-like refractory material and water in a desired mixing must be sprayed onto the furnace lining from the spray nozzle.

Especially when applying refractory material while the furnace is still hot, the spraying causes a fall in the temperature within the furnace.

Therefore, the amount of water to be mixed with the powder-like refractory material must take into account the furnace temperature, since the adhering force (adhesiveness) and rebound loss of the sprayed refractory material are greatly affected by the water percentage in the slurry-like refractory material and the temperature in the furnace.

Conventionally, adjusting the water to be mixed is done by throttling a manual valve disposed at the middle of the water supplying tube. Manual operation, however, cannot achieve fine adjustment of the water addition since it depends mainly on the experience of a skilled operator. Furthermore, due to the nature of the spraying operation, the manual throttling is subject to high radiation heat temperature from the furnace.

(2) In the water-cooled construction provided in the conventional spray apparatus, a shooting pipe has a concentric dual pipe construction where the inside pipe thereof passes the refractory material therethrough. Furthermore, the space between the inside pipe and the outside pipe is divided into two or more sections by means of partitions. These sections are used as a feeding and returning way for cooling water. In addition to the above-mentioned water-cooled construction, a guide, or a key and a keyway are required as a mechanism to rotate the shooting pipe about its axis and to move it along its axis. For that purpose, it is difficult from the view point of machining to divide the space between the concentric pipes into two or more sections by means of partitions, which entails a number of processing stages. Furthermore, because a guide or a key and a keyway, which allow the shooting pipe to rotate or move must be separately manufactured, the manufacturing of said pipe becomes more complicated.

Accordingly, it is an object of the present invention to provide an apparatus for applying a refractory lining onto the inner surface of a furnace which can resolve the above-mentioned defects while keeping the advantages of the improved type of apparatus devised by the applicant of this invention.

It is an another object of the present invention to provide such lining apparatus which is provided with a water-regulating system which can finely and accurately regulate the amount of water to be added into the powder-like refractory material.

It is still another object of the present invention to provide such lining apparatus which can automatically cool the shooting pipe during the spraying operation.

It is a further object of the present invention to provide such lining apparatus which is provided with a central control system such that an operator can manipulate all the devices mounted on the transport car easily and precisely while sitting on the seat mounted on the apparatus throughout the spraying operation.

It is still further object of the present invention to provide such lining apparatus which is provided with many other constructional improvements which enhances the mobility and operability of the apparatus such as the means which oscillate the rotation of the shooting pipe.

BRIEF DESCRIPTION OF THE DRAWINGS

FIG. 37 is another explanatory view showing the relationship among rotating angle ($\alpha$), tilting angle ($\beta$) and slide length (X) of shooting pipe.

FIG. 38 is a side view of a modified measuring car.

DETAILED DESCRIPTION OF THE DISCLOSURE

Figure 1:
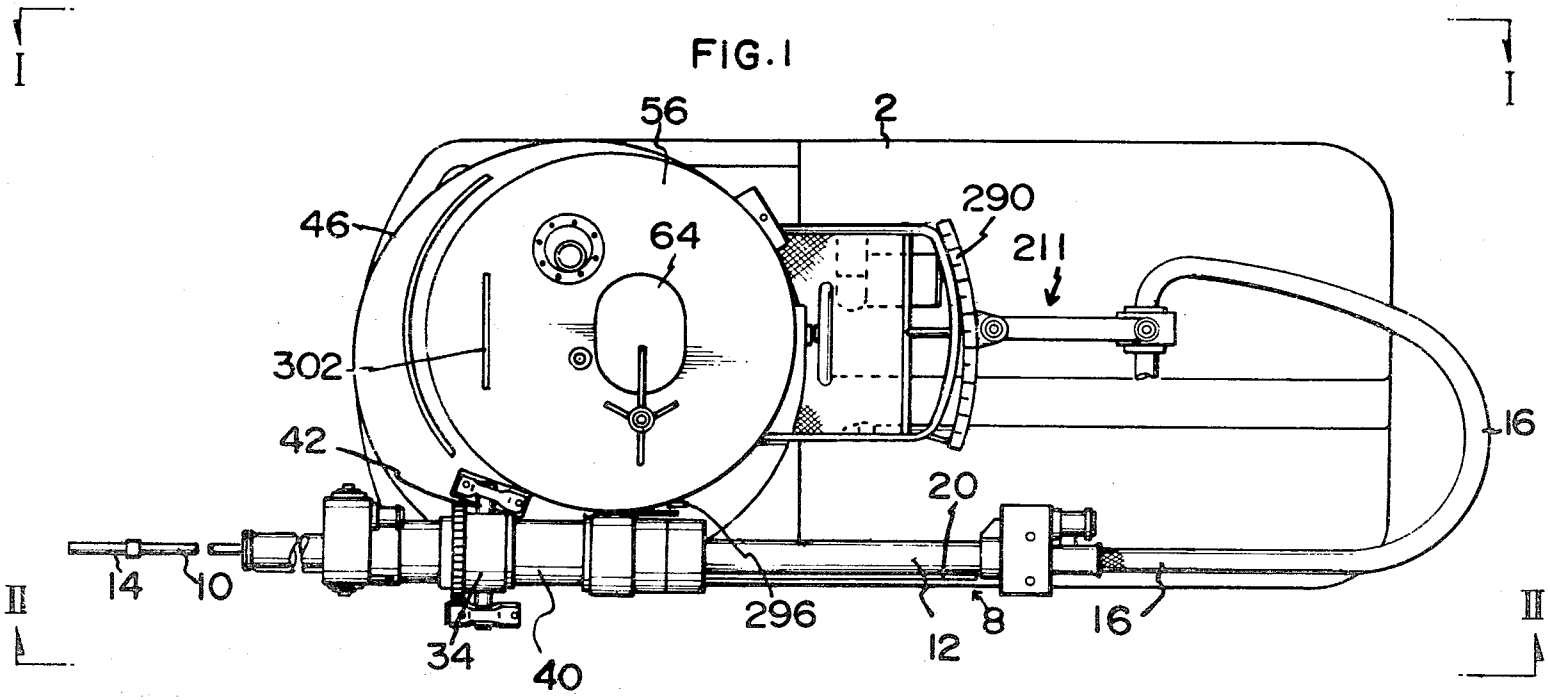
FIG. 1 is a plan view of the lining apparatus of this invention which is provided with the water regulating system.
Figure 2:
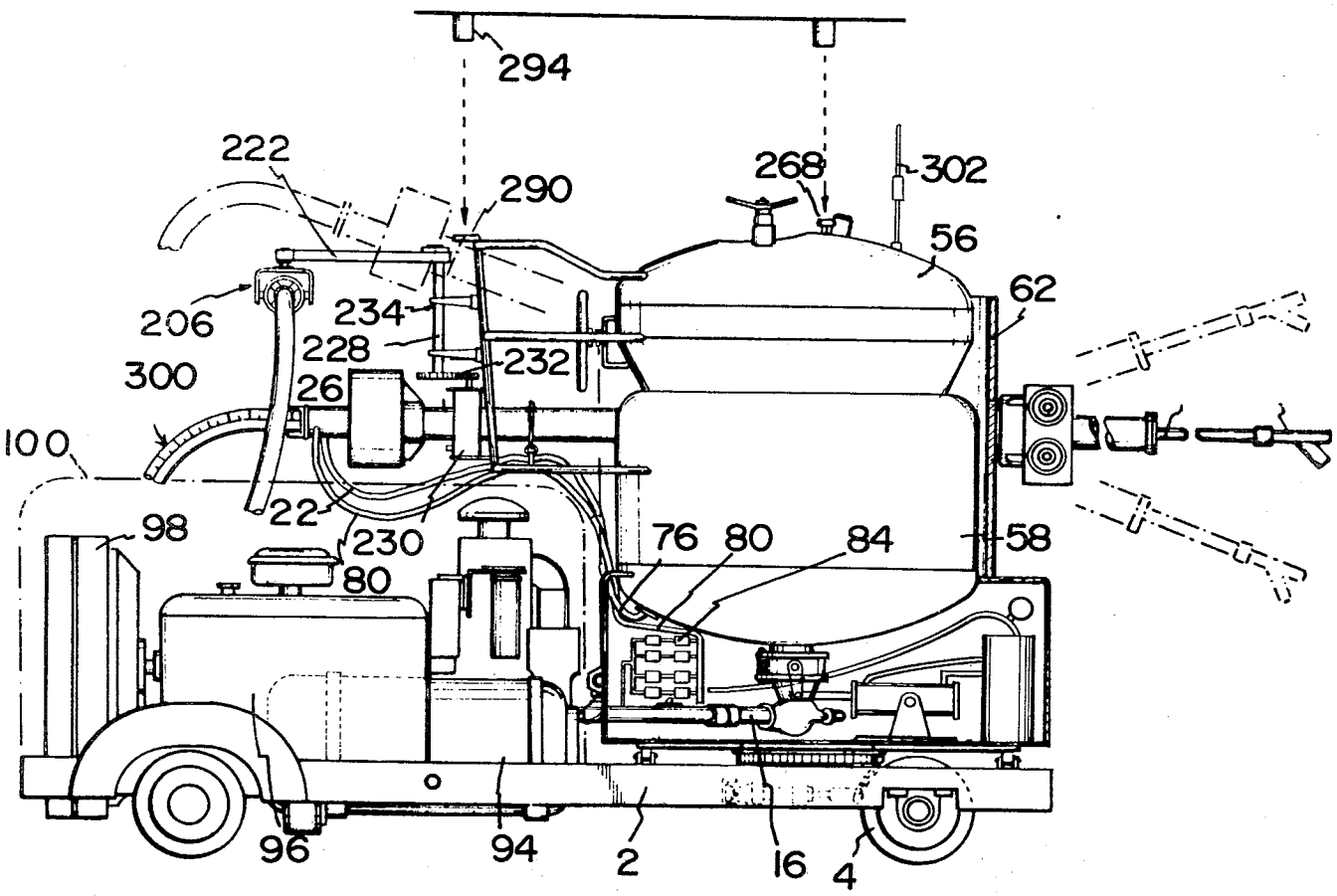
FIG. 2 is a side view of above apparatus taken along the line I—I of FIG. 1.
Figure 3:
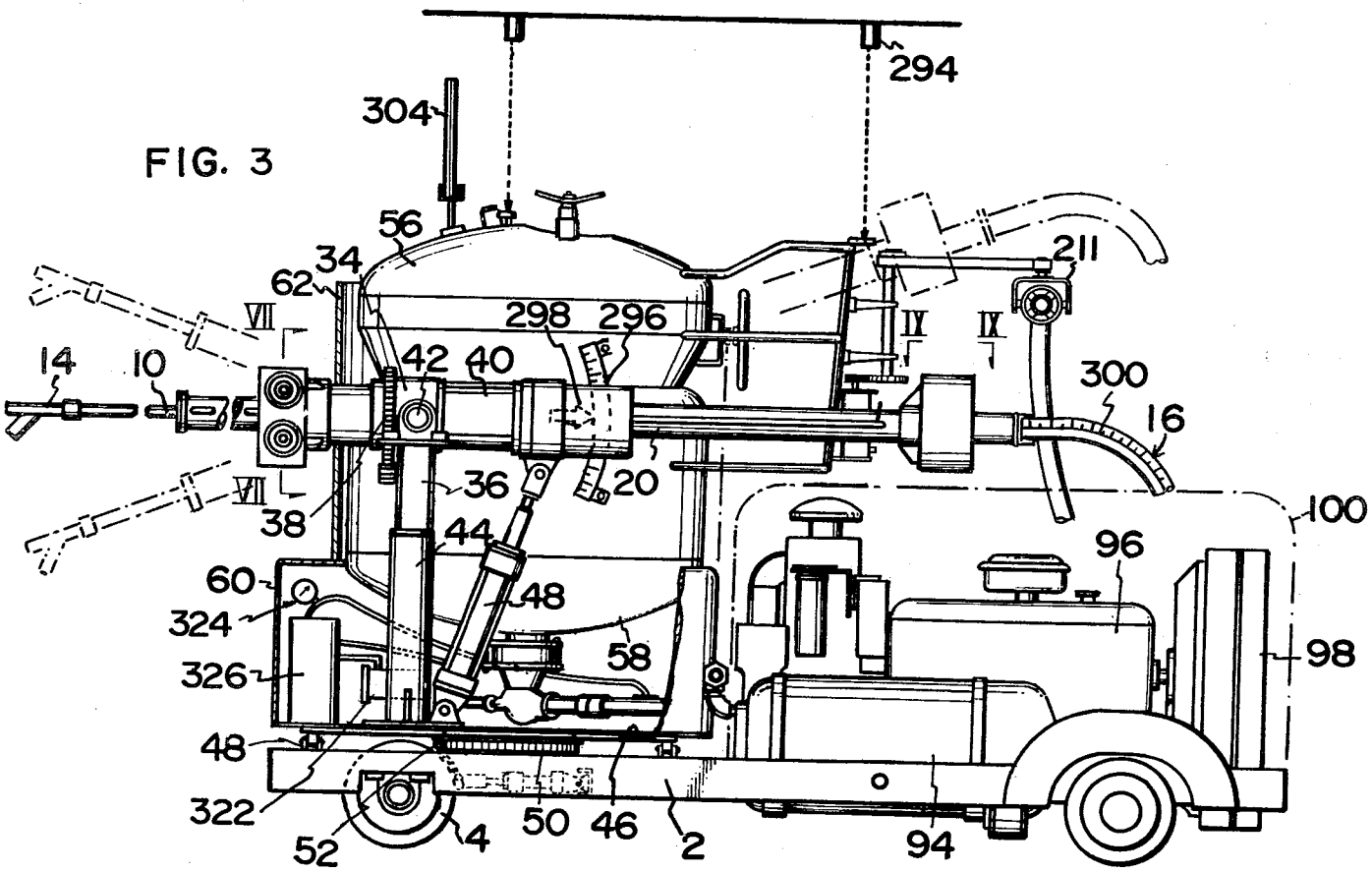
FIG. 3 is another side view with a part broken away of the apparatus taken along the line II—II of FIG. 1.
Figure 4:
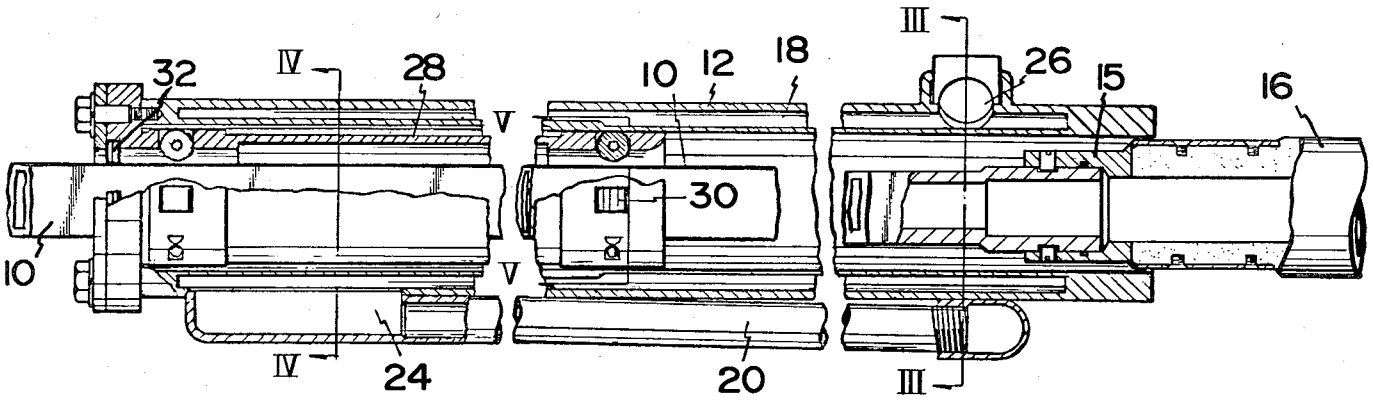
FIG. 4 is a longitudinal cross-sectional view of the shooting pipe provided with a unique water-cooling system which is devised for the lining apparatus of this invention.
Figure 7:
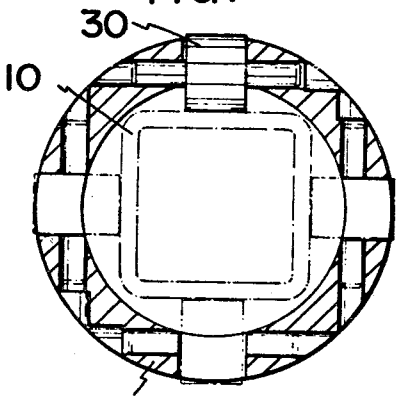
FIG. 7 is a transverse cross-sectional view of the above shooting pipe taken along the line V—V of FIG. 4.
Figure 6:
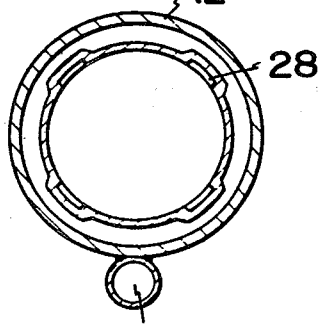
FIG. 6 is a transverse cross-sectional view of the above shooting pipe taken along the line IV—IV of FIG. 4.
Figure 5:
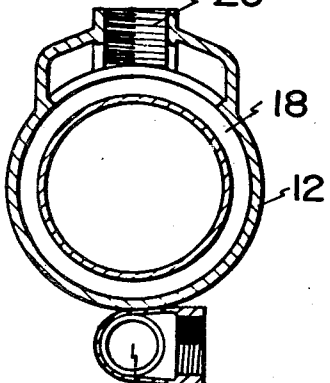
FIG. 5 is a transverse cross-sectional view of the above shooting pipe taken along the line III—III of FIG. 4.

The apparatus for repairing the furnace lining is described in conjunction with the attached drawings. Referring to FIG. 1 through FIG. 3, there is shown a transport car 2 provided with wheels 4 driven by hydraulically-operated motors so that the car 2 is movable both backwards and forwards. Above and substantially parallel to the transport car 2, there is shown a shooting pipe 8 of duplicate construction consisting of an inner pipe 10 and an outer pipe 12.

The inner shooting pipe 10 of a square hollow cross-section is provided with a spray nozzle 14 at the front extremity thereof and has the rear end thereof rotatably connected by a specifically devised swivel joint 15 with a flexible hose 16 through which refractory material in either dry or wet form is supplied to the inner shooting pipe 10.

The other end of the flexible hose 16 is connected to a refractory material supply source which is described later. The inner shooting pipe 10 is slidably disposed inside the outer shooting pipe 12 such that the shooting pipe 8 as a whole can be extended in a telescopic manner. This shooting pipe 8 is also provided with a cooling system which is shown in FIG. 4 to FIG. 7 in detail.

Namely, the outer shooting pipe 12 is partially or entirely of duplicate construction wherein the inner passage thereof works as a passage for sliding an inner shooting pipe 10 therethrough and the outer passage thereof works as a cooling water supply chamber 18 into which the cooling water is supplied by way of a cooling water supply pipe 20 which is parallely secured to the outer periphery of the outer shooting pipe 12. This cooling water supply pipe 20 has one end connected to a cooling water supply tube 22 which is communicated with a water-storage tank 58 (this tank 58 is described later) and the other end connected to the water supply chamber 18. The supply pipe 20 also works as an elongated guide for the slide movement of the shooting pipe 12 relative to a rotating boom 40 of a cylindrical body 34.

In the drawings, the outer shooting pipe 12 is provided with a water inlet 24 and a water outlet 26 at the rear end thereof. For facilitating the smooth movement of the inner shooting pipe 10 relative to the outer shooting pipe 12, an intermediate cylindrical sleeve 28 is fixedly secured along and within the outer shooting pipe 12 such that a roller means 30 disposed equidistantly at both ends of the intermediate sleeve 28 imparts the smooth movement of the inner shooting pipe 10 relative to the intermediate sleeve 28. Numeral 32 indicates a scraper ring which prevents the intrusion of dust and other foreign materials into the space between the intermediate sleeve 28 and the inner shooting pipe 10.

Furthermore, the outer shooting pipe 12 is rotatably and slidably disposed within the cylindrical body 34 which is substantially disposed at the front of the transport car 2. A power-operated motor 36 and a gear mechanism 38 which are both attached to the cylindrical body 34 in place cause the rotation of the outer shooting pipe 12 by way of the rotating boom 40 relative to the cylindrical body 34. The rotating boom 40 forms a part of the cylindrical body 34.

This cylindrical body 34 is tiltably mounted by a pivot shaft 42 on the top of a vertical support structure 44 which in turn has the bottom end fixedly secured to the upper surface of a turntable 46. A hydraulic cylinder 48 is diagonally disposed on the turntable 46 for the purpose of tilting the cylindrical body 34. This turntable 46 is supported by a plurality of roller means 49 which are disposed in a circle at the lower periphery of the turntable 46.

The turntable 46 further includes a worm wheel 50 which meshes with a worm 52. The worm 52 is driven by a suitable driving means 54, such as a power-operated motor, so as to rotate the turntable 46 by way of the worm wheel 50.

On the turntable 46, a tank means consisting of a storage tank 56 for powder-like refractory material and another storage tank 58 for water is mounted by means of support columns 60 such that the vertical axis of the tank is aligned with the axis of the turntable 46. These tanks, 56 and 58, are concentrically disposed within each other wherein the discharge outlet of the conical-shaped refractory material tank 56 is disposed just below the center of the bottom of the water storage tank 58. A heat insulating shield 62 is provided in front of the tank means.

The storage tank 56, which is usually subject to a desired pressure therein, has a charging inlet 64 at the top thereof and a discharge outlet 66 at the bottom thereof.

This storage tank 56, if desired, can store the wet slurry form refractory material. In this case, the addition of water into the powder-like refractory material is unnecessary.

Figure 8:
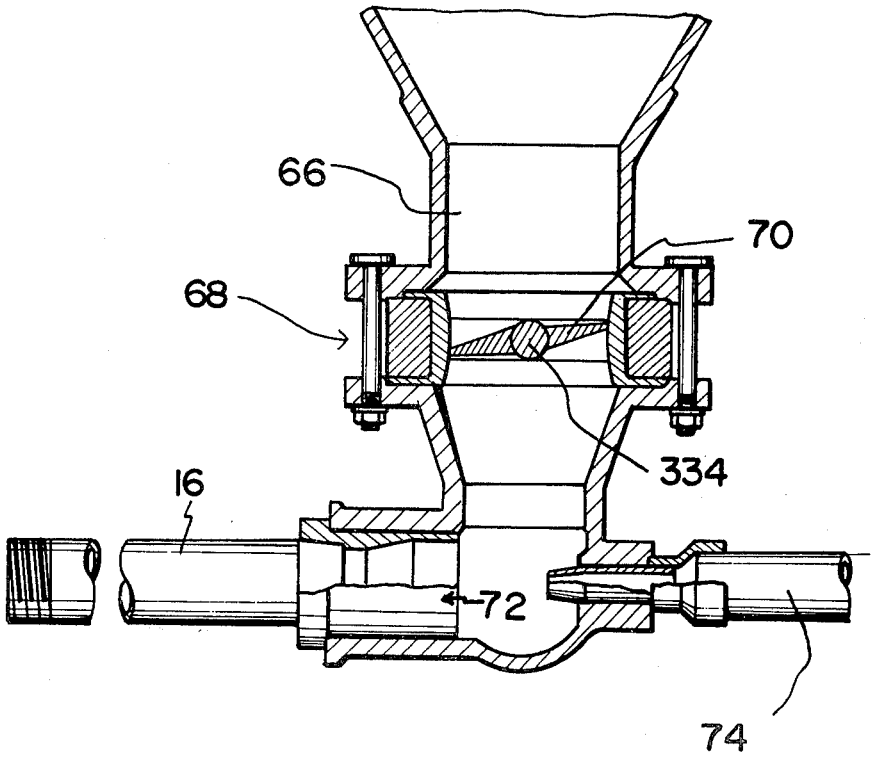
FIG. 8 is a cross-sectional front view of the flow regulating valve of the above apparatus.

As shown in FIG. 8, below the outlet 66 of the storage tank 56, a flow regulating valve 68 is disposed which regulates the amount of refractory material to be supplied by a throttle plate 70 thereof.

The flow regulating valve 68 has an opening 72 at the lower end thereof which, in turn, communicates with the flexible hose 16 through which the refractory material is charged to the inner shooting pipe 10.

In order to give flow energy to the refractory material which passes through the flexible hose 16 and the inner shooting pipe 10, an air jet gun 74 is provided at the lower end of the flow regulating valve 68 disposed opposite to the opening 72.

The water storage tank 58 which is provided for supplying the cooling water to the cooling system has a water outlet 76 at the bottom thereof which is communicated with the cooling water supply tube 22. This cooling water supply tube 22, as has been said before, has its other end connected to the inlet of the cooling water supply pipe 20 formed to the outer periphery of the outer shooting pipe 12 such that the water charged into the cooling water supply chamber 18 of the shooting pipe 12 cools the entire shooting pipe 8, which is subject to high radiation heat temperature during the spraying operation.

The outer shooting pipe 12 has another water outlet opening 26 which is connected to a warm water return tube 80 wherein the water warmed during the circulation thereof within the shooting pipe 8 is discharged into the return tube 80 by way of the outlet opening 26.

The return tube 80 has its other end connected to the flexible hose 16 at the middle thereof by way of a three-port valve 82 wherein the warmed water which passes through the return tube 80 is mixed with the powder-like refractory material to produce refractory material in a wet slurry form which is charged into the inner shooting pipe 10 by way of the flexible hose 16.

In the middle of the return tube 80, a system for regulating the amount of water to be mixed with the powder-like refractory material is provided. The system, which features the present invention, has the following construction.

Figure 9:
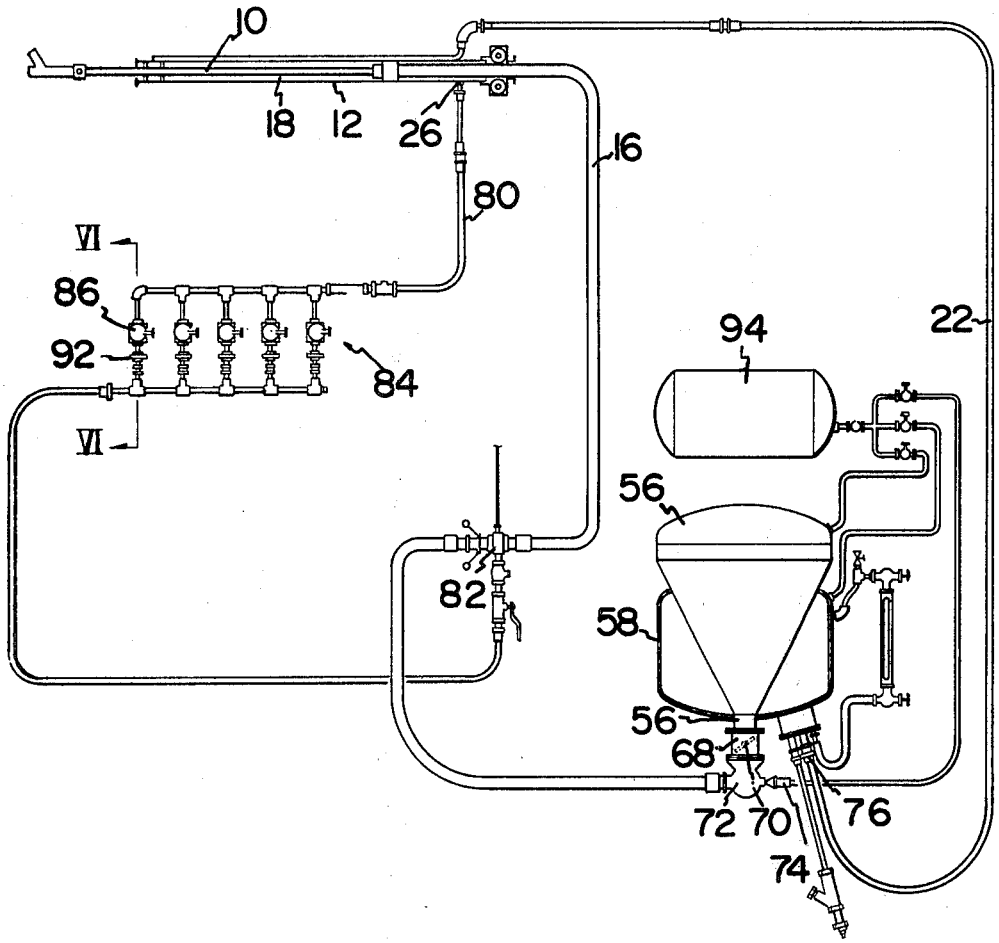
FIG. 9 is an illustrative view of the system for regulating the amount of water to be mixed with refractory material which is provided for the lining apparatus of this invention.
Figure 10:
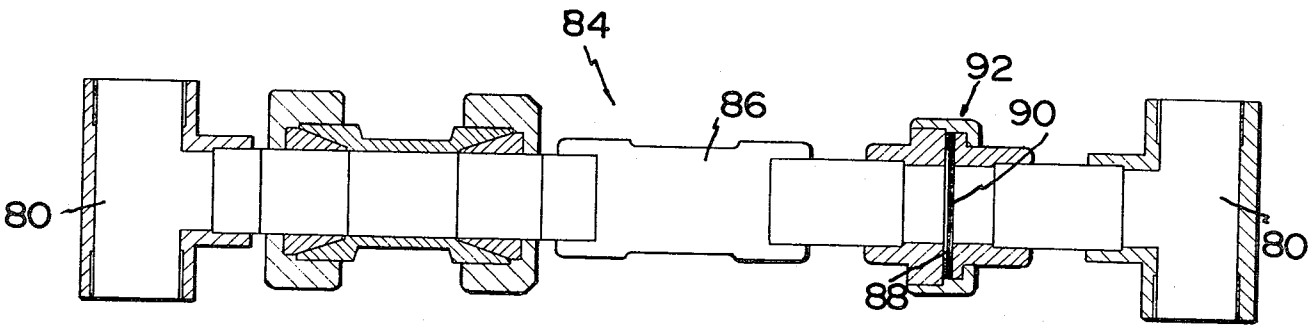
FIG. 10 is an enlarged cross-sectional view of FIG. 9 taken along the line VI—VI showing the detail of the regulating system.

In FIG. 9 and FIG. 10, a plurality or a desired number of communicating members 84 are parallely disposed in the middle of the warmed water return tube 80, wherein each communicating member 84 is provided with a solenoid valve 86 and an orifice plate 88 having a different number of orifices 90 formed thereon respectively. Each orifice plate 88 is encased in an orifice casing 92.

The total flow area of each orifice plate 88 is the multiplication of the flow area of each orifice plate 88 and number of orifices 90.

In this embodiment, an operator selects a desired combination of orifice plates 88 such that the total flow area of those orifice plates 88 are opened by energizing the corresponding solenoid valves 86 whereby a desired amount of warmed water is supplied into the flexible hose 16.

Figures 11, 13, 14:
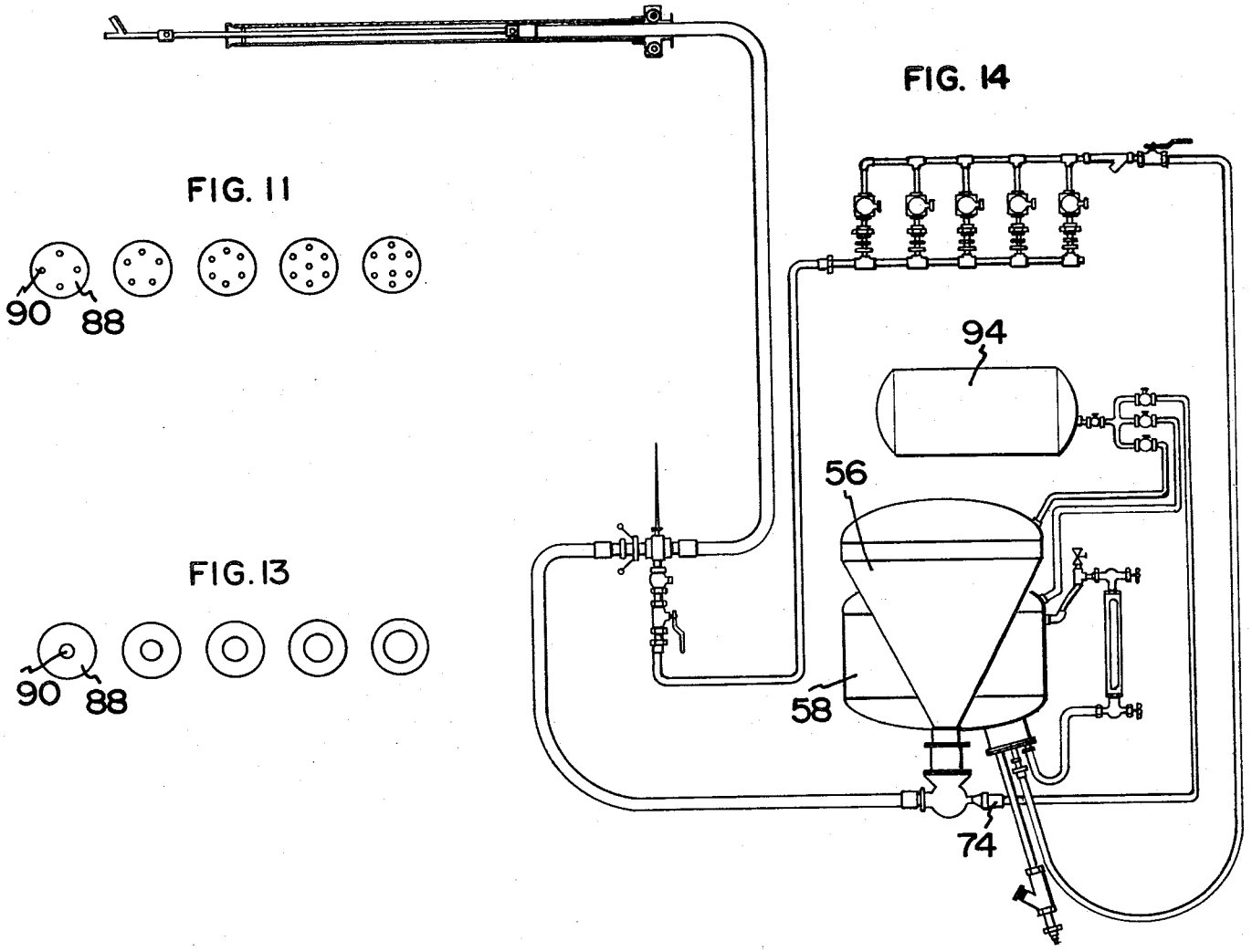
FIG. 11 is an explanatory view of the orifice plates employed in the above water regulating system.
FIG. 13 is another explanatory view showing the modification of orifice plates.
FIG. 14 is another illustrative view of the water regulating system applied to the water supply means which directly supplies the water to the flexible hose without cooling the shooting pipe.
Figure 12:
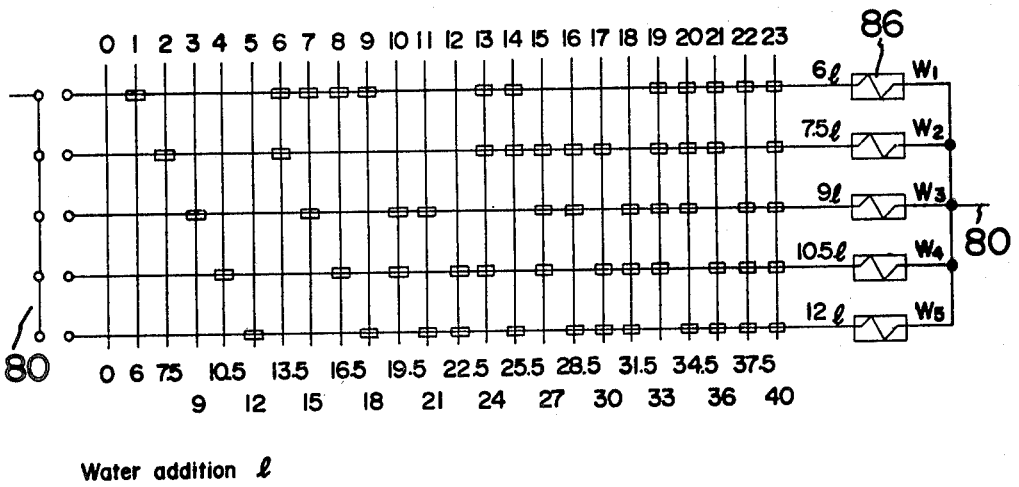
FIG. 12 is a schematic chart showing the variation of the water to be mixed with the energization of solenoid valves.

In FIG. 11, as an example, five orifice plates 88 are shown wherein the number of orifices 90 are chosen in the ratio 4:5:6:7:8. Due to the above selection of orifice numbers, more than 20 combinations can be made in view of the number of orifices 90 (from 0 to 30 orifices). If each orifice is designed such that it passes through 1.5 liter per a minute, the amount of water to be added to the powder-like refractory material can be varied as shown in the chart of FIG. 12.

The chart clearly shows that the amount of water to be supplied along the warmed water return tube 80 can be regulated in a wide range automatically and with great accuracy.

The orifice plate may be prepared in a manner shown in FIG. 13 wherein the orifice plates 88 are provided with single orifices of different sizes respectively.

If the rough regulation of the water is permissible, all the orifice plates 88 may be deleted so that the water may be regulated in a rough manner. The degree of roughness in view of regulation depends on the number of solenoid valves. Namely, if the roughness should be alleviated, the number of solenoid valves are increased.

Furthermore, if desired, a slide plate which has the desired number of orifices formed thereon can be disposed in the middle of the warmed water supply tube wherein the amount of warmed water to be supplied to the flexible hose 16 is regulated by the transverse slide movement of the slide plate without necessitating a solenoid valve.

In short, the amount of water to be supplied to the flexible hose is digitally regulated automatically by selecting a desired combination of orifice plates whereby the accurate regulation of the water is achieved and the regulating operation is simply and easily conducted.

Although the water regulating system is disclosed in view of the warmed water return tube, it must be noted that such a system can be arranged in the middle of the flexible hose 16 such that it directly supplies water to the flexible hose 16 without cooling the shooting pipe 8 as shown in FIG. 14.

At the rear of the transport car 2, an air compressor 94 is provided which supplies compressed air to the air jet gun 74, the water storage tank 58, the refractory-material storage tank 56 and other parts of the apparatus which require compressed air as shown in FIG. 14. A diesel engine 96 for moving the transport car 2 is also mounted at the rear portion on the transport car 2 along with its radiator 98.

This air compressor 94 and the diesel engine 96 are both protected from dust and the like by a cover means 100.

Figure 15:
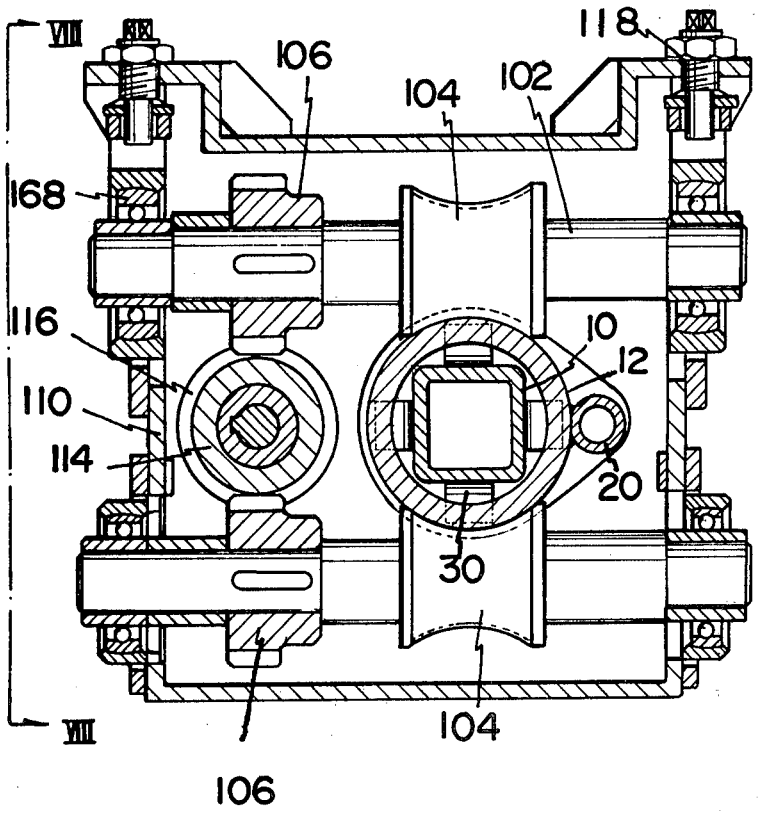
FIG. 15 is an enlarged transverse cross-sectional view of the slide means of this apparatus for sliding the outer shooting pipe taken along the line VII—VII of FIG. 3.
Figure 16:
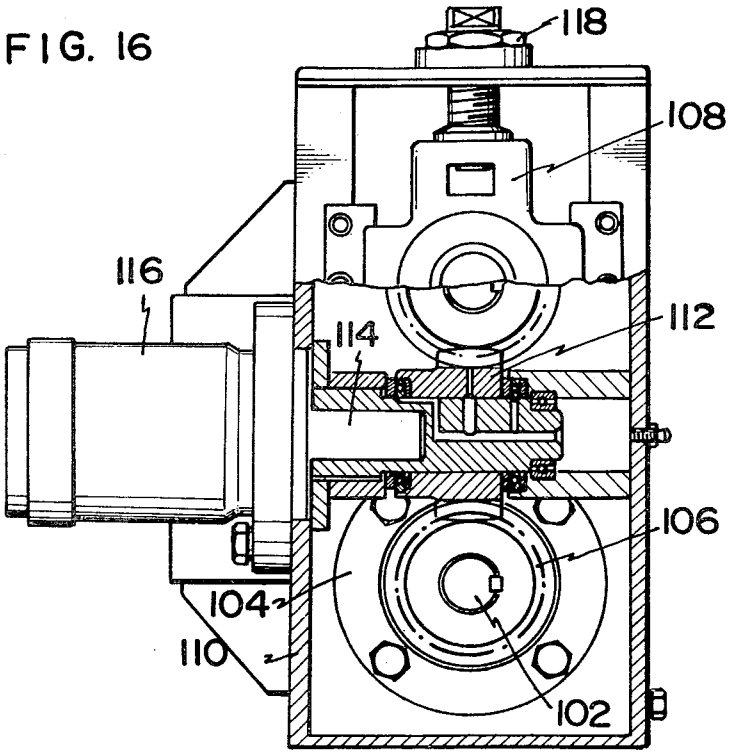
FIG. 16 is a side view of the above slide means taken along the line VIII—VIII of FIG. 15.

In FIG. 15 and FIG. 16, the mechanism to slidably move the outer pipe 12 relative to the rotatable boom 40 of the tiltable cylindrical body 34 is shown wherein each roller shaft 102 which fixedly carries a pipe-propelling roller 104 and a spiral gear 106 in series has both ends thereof journaled by ball-bearings 108 which, in turn, rest within openings formed at the side walls of a casing 110. A spiral gear 112 which is fixedly mounted on a drive shaft 114 of a power-operated motor 116 is meshed with spiral gears 106 so that the actuation of the motor 106 causes the rotation of the pipe-propelling rollers 104 which, in turn, move the outer shooting pipe 12 forward or backward within and relative to the rotatable boom 40 of the cylindrical body 34.

The pressure to pinch the outer shooting pipe 12 by the two opposing rollers 104 is adjusted by a bolt and nut means 118 disposed above each ball-bearing 108.

Figure 17:
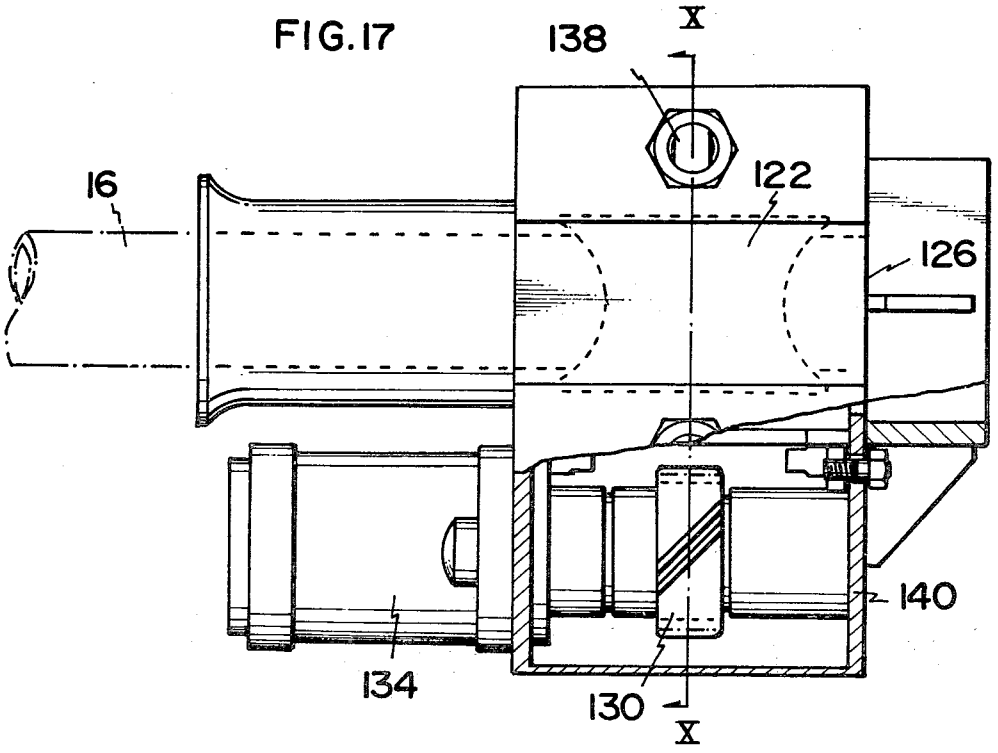
FIG. 17 is an enlarged plan view of the slide means of the apparatus for sliding the inner shooting pipe relative to the outer shooting pipe taken along the line IX—IX of FIG. 3.
Figure 18:
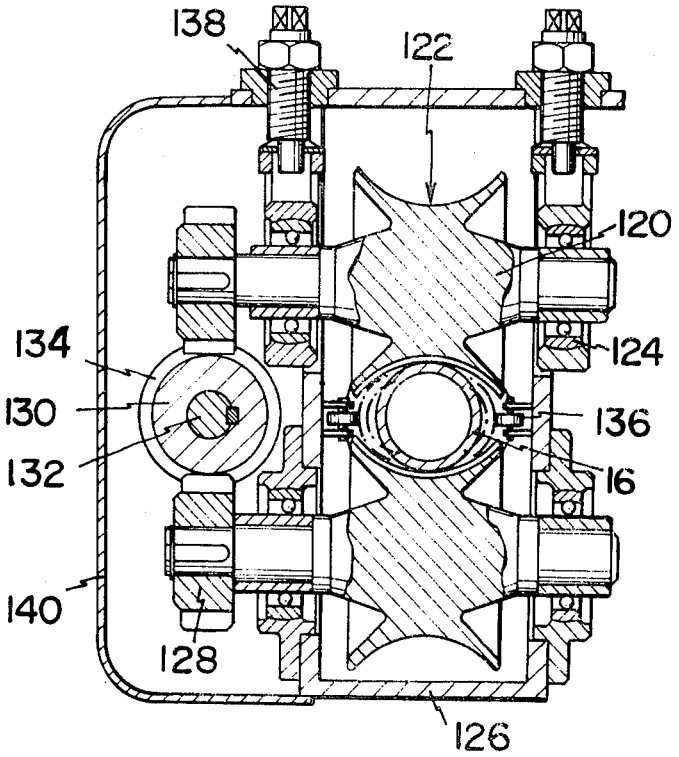
FIG. 18 is a longitudinal cross-sectional view of the above slide means taken along the line X—X of FIG. 17.

In FIG. 17 and FIG. 18, the mechanism to slidably move the inner shooting pipe 10 relative to the outer shooting pipe 12 is shown wherein each parallely-disposed roller shaft 120 which is integrally provided with a second pipe-propelling roller 122 has both ends journaled by ball-bearings 124 which rest in openings formed at the side walls of a casing 126. Each roller shaft 120 is further provided with a spiral gear 128 at the extension adjacent to one journaled portion thereof. A spiral gear 130 which is fixedly mounted on a rotating shaft 132 of a power-operated motor 134 is meshed with spiral gears 128 so that the actuation of the motor 134 causes the rotation of the second pipe-propelling rollers 122 which, in turn, slidably move the inner shooting pipe 10 forward or backward within and relative to the outer shooting pipe 12.

To be more specific and exact, the second pipe-propelling rollers 122 pinch the flexible hose 16 (not the inner shooting pipe 10) as can be observed from FIG. 18. When the above rollers 122 are rotated by the activation of motor 134, the flexible hose 16 which is now depressed in an elliptical hollow cross section is moved longitudinally in either forward or backward direction due to the friction at the inter-surface of rollers 122 and flexible hose 16.

As described previously, since the hose 16 is connected with the inner shooting pipe 10, the inner shooting pipe 10 moves backwards or forwards longitudinally along with the flexible hose 16.

The casing 136 is also provided with two opposing side rollers 136 which rotatably come into contact with the expanded round side of the hose 16 so as to guide the hose 16.

The pressure to pinch the flexible hose 16 by the two opposing rollers 122 is adjusted by a bolt and nut means 138 disposed above each ball-bearing 124. Spiral gears 128 and 130 are protected from dust or the like by a cover means 140 which is fixedly attached to the outer shooting pipe 12 together with the casing 126.

Figure 19:
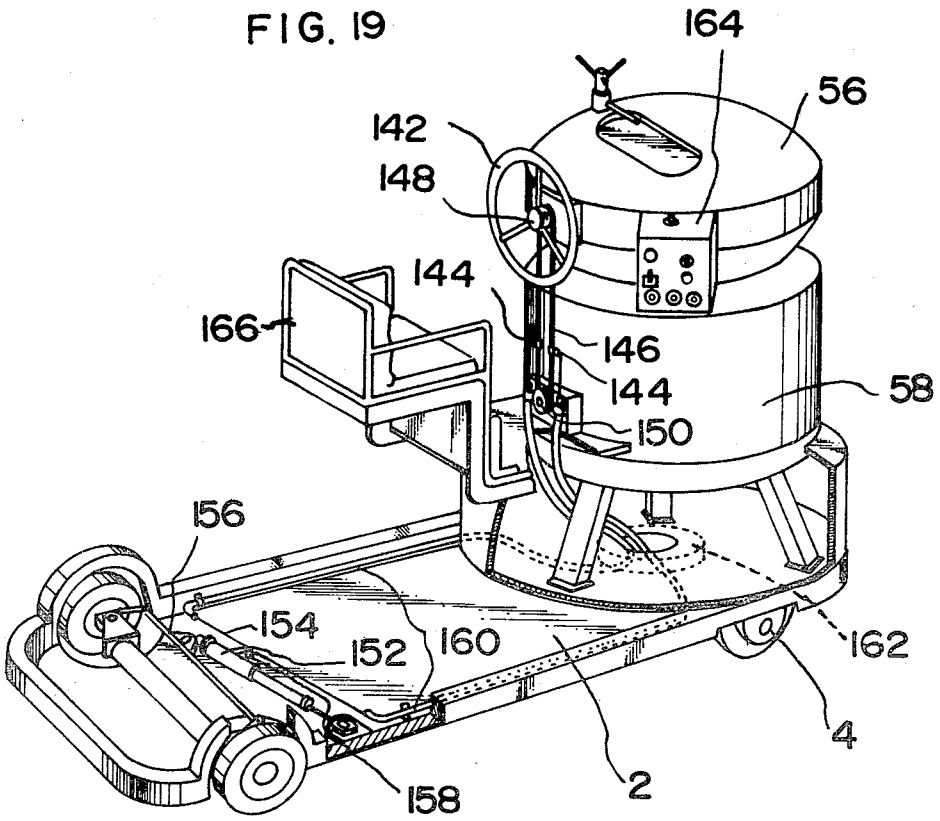
FIG. 19 is a schematic view of the skeleton structure of the above lining apparatus showing the mechanism for steering the transport car.

Referring to the means for controlling the apparatus of this invention in FIG. 19, a steering wheel 142 which steers the transport car 2 hydraulically by manipulating the rear wheels 4 is disposed adjacent to the upper portion of the refractory material storage tank 56.

The mechanism to steer the transport car 2 has the following construction.

In FIG. 19, two lugs 144 which vertically move in an opposite way by the rotation of the steering handle 142 are attached to an endless chain 146 which is extended between a steering handle shaft 148 and a follower shaft 150. These lugs 144 are connected with a hydraulic power steering 152 by means of throttling wires 154. This power steering 152 which can steer the rear wheels 4 has one end connected with a rear wheel steering link 156 and the other end pivotally secured to the frame of the transport car 2. Referring to other parts of this mechanism, numeral 158 indicates a throttling lug to which throttling wires 154 are connected, numeral 160 indicates casing tubes which slidably enclose throttling wires 154 and numeral 162 indicates a hollow rotary shaft for running the electric connections and hydraulic circuits as well as throttling wires.

Figure 20:
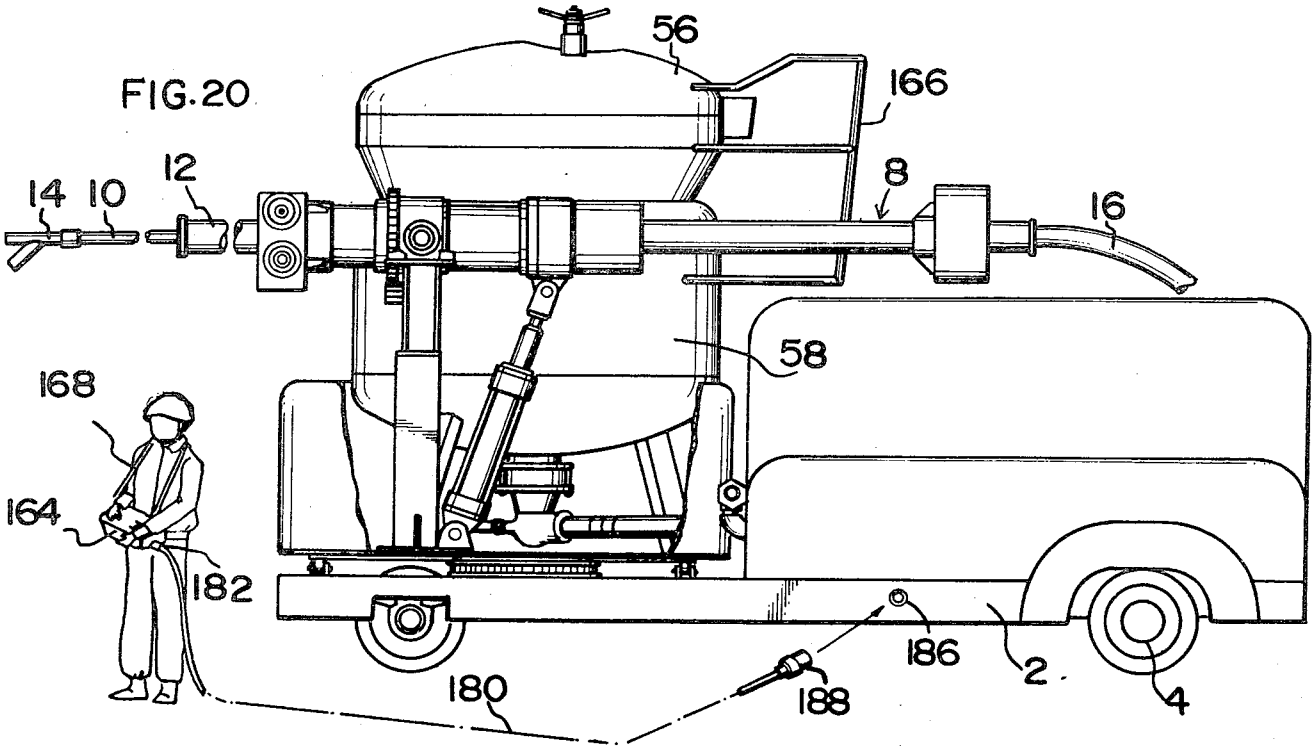
FIG. 20 is a side view of the above apparatus regulated by a remote control means.
Figure 21:
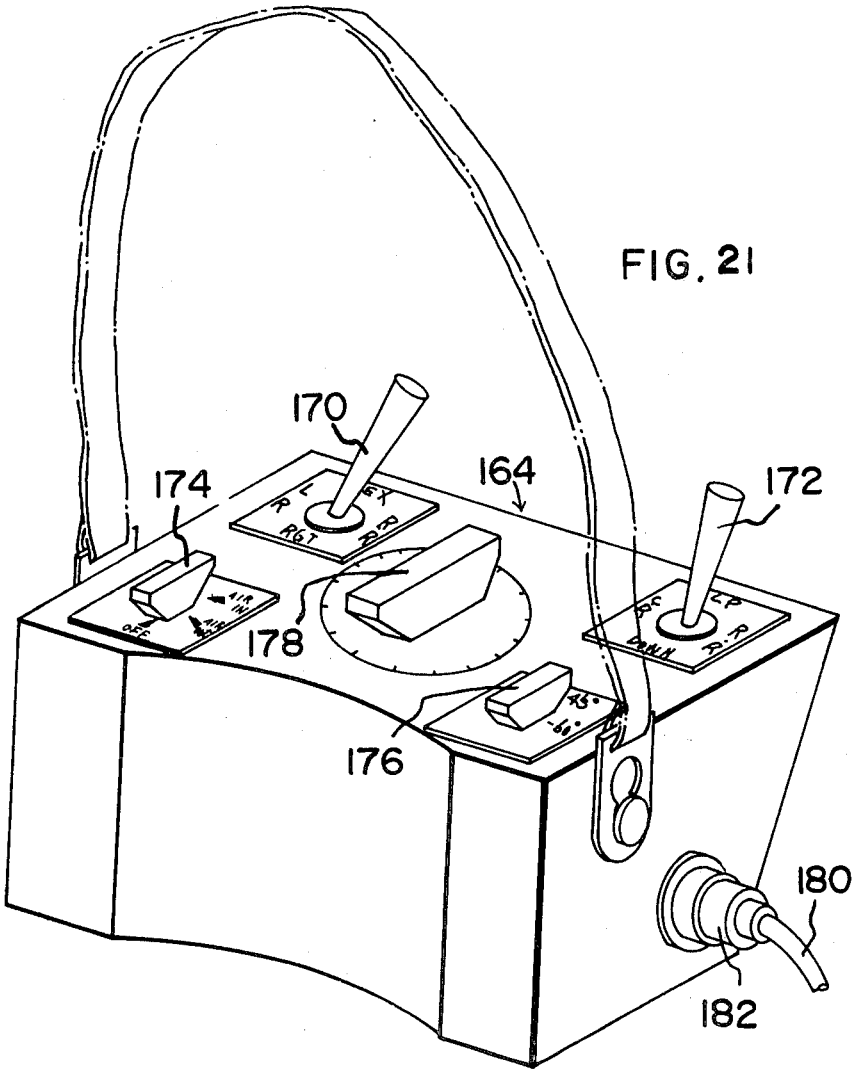
FIG. 21 is a schematic view of the above remote control means of FIG. 20.
Figure 22:
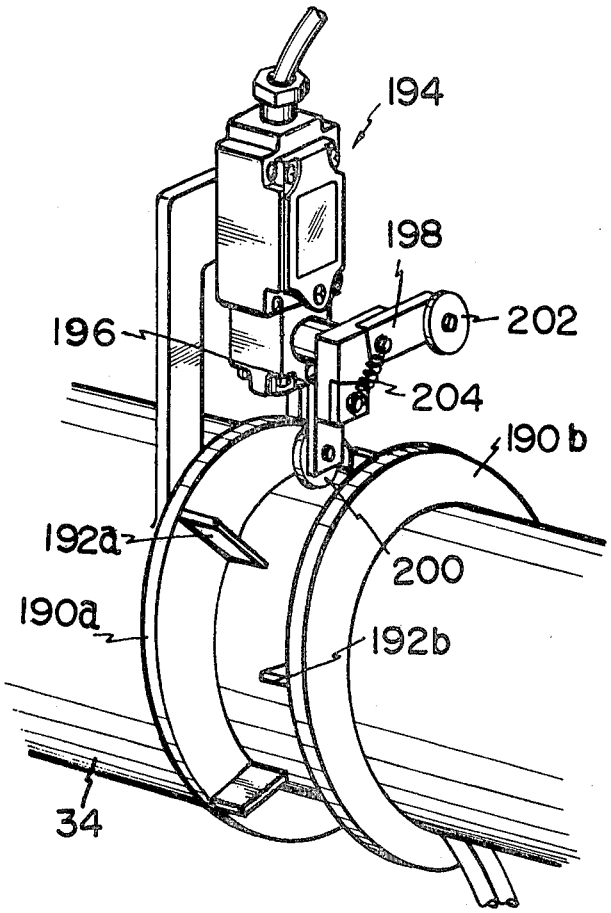
FIG. 22 is a schematic view of a means for imparting the oscillation to the rotation of the shooting pipe.
Figure 24:
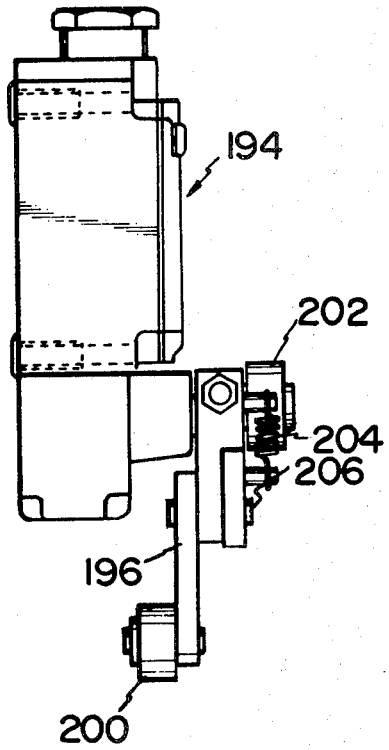
FIG. 24 is a side view of the above limit switch.
Figure 23:
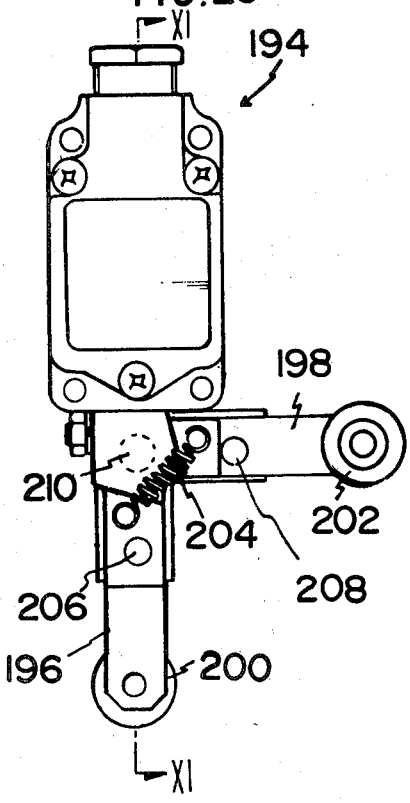
FIG. 23 is a front view of a limit switch employed in the above oscillating means.

Of course, a control panel 164 for controlling the apparatus of this invention which is mounted on the side of the storage tank 56 adjacent to a steering seat 166 can be made into a portable type one as shown in FIG. 20 so as to facilitate the remote control of the apparatus wherein the operator can hang the portable control panel or device 164 from his shoulder by a suspending belt 168. The portable control device 164 is provided with the desired number of switching means as shown in FIG. 21 wherein a first lever 170 controls the longitudinal movement and horizontal rotation (by turntable) of the shooting pipe 8, a second lever 172 controls the tilting movement and rotation on the axis (by pipe rotating means) of the shooting pipe 8, a third lever 174 controls the supply of water and/or air, a fourth lever 176 selects the horizontal rotation angle of the shooting pipe either 45 degrees or 60 degrees, and a fifth lever 178 regulates the amount of water to be mixed with refractory material in a powder-like form.

The remote control means is further provided with the following parts wherein numeral 180 indicates remote control wiring which has one end electrically connected with a terminal 182 of the control panel 164 by way of a connector 184 and another end connected with a terminal 186 of the electric circuit arranged within the lining apparatus by way of another connector 188.

The manner in which the apparatus of this invention is operated is disclosed hereinafter.

The powder-like refractory material is discharged from the hopper-like storage tank 56 by compressed air supplied from the air compressor 94 wherein the flow amount is regulated by the flow regulating valve 68. After the above regulation, the refractory material is conveyed through the flexible hose 16 with flow energy given by the air jet from the air jet gun 74. The powder-like material subsequently passes through the shooting pipe 8 and eventually is sprayed from the spray nozzle 14.

In this invention, the water which is supplied to the shooting pipe 8 from the water storage tank 58 for cooling the shooting pipe 8 is available. Namely, the cooling water is discharged from the water storage tank 58 by compressed air which is supplied from the air compressor 94. The cooling water then passes through the cooling water supply tube 22 into the shooting pipe 8.

The water which is warmed after the above cooling operation is discharged from the outlet 26 and passes through the warmed water return tube 80 and reaches the water regulating system.

In this water regulating system, with the energization of chosen solenoid valves 86, the desired amount of water to be mixed with the powder-like refractory material is obtained at the end or outlet of the water regulating system.

Thus obtained water flows into the three port valve 82. By opening the three port valve 82, the powder-like refractory material from the refractory material storage tank 56 and the warm water from the shooting pipe 8 are mixed together forming refractory material in a wet slurry form at the junction where the return tube 80 and the flexible hose 16 meet. The thus produced slurry-like refractory material is supplied to the shooting pipe 8 and finally is sprayed from the spray nozzle 14 onto the inner surface of the furnace.

With respect to the longitudinal movement of the shooting pipe 8, since the shooting pipe 8 is of duplicate construction consisting of an inner and outer shooting pipe 10, 12, the shooting pipe 8 can be extended even to the deepest part of the furnace so that a complete repair operation is assured.

Since the refractory material storage tank 56 and the water storage tank 58 are concentrically mounted adjacent to the support structure 44 on the turntable 46, they do not obstruct the rotating movement of the shooting pipe 8. Furthermore, by restricting the height of the air compressor 94, the shooting pipe can also be freely pivoted on the support 44 by means of the turntable 46. It should be noted that the shooting pipe 8 is not necessarily a slidable one but can be fixedly mounted on the support structure 44.

In this invention, since all the necessary devices for applying a lining of a refractory material, heat insulating material, other insulating material and cement, namely, the shooting pipe control device, the storage tank, power-supply device, are all neatly mounted on the transport car, the apparatus can conduct the lining operation with high mobility and without the need of any other devices.

Furthermore, it can easily and freely conduct the spraying operation due to the shooting pipe control device.

Accordingly, the apparatus of this invention has the following advantages:

Since the desired amount of water can be added into the powder-like refractory material, the refractory material sprayed from the spray nozzle can adhere onto the abraded or eroded portion of the furnace lining with little rebound loss.

Referring to the other features of the apparatus which form the parts of the present invention, the following constructions can be considered.

(1) Means for oscillating the shooting pipe

The lining apparatus of this invention is provided with a means to impart oscillation to the rotation of the shooting pipe.

The construction of the oscillating means is described hereinafter in conjunction with FIG. 22 through FIG. 26.

In the drawings, two spaced-apart circular ring plates 190*a* and 190*b* are formed onto the rotating boom 40 adjacent to the pivot pin 42 which tiltably connects the cylindrical body 34 to the support column 44. Each ring plate 190*a* and 190*b* has a plurality of contacting pads 192*a* or 192*b* secured equidistantly on the side thereof which faces the corresponding side of another ring plate 190*a* and 190*b*. A fork-lever-shaped limit switch 194 which is provided with two pressure detecting levers 196, 198 is fixedly mounted on the top of the cylindrical body 34 wherein one detecting lever 196 is disposed in the rotating passage of the row of contacting pads 192*a* while another detecting lever 198 is disposed in the rotating passage of another row of connecting pads 192*b*.

The limit switch 194 which is especially applicable to the oscillating means of this apparatus further comprises contact rollers 200 and 202 attached to respective ends of the levers 196 and 198 and spring means 204 which tends to position the levers 196 and 198 in alignment with the body of the limit switch 194 unless no contact pressure is applied to the contact rollers 200 and 202.

In this invention, when the rotating boom 40 which encloses the outer shooting pipe 12 is rotated relative to the cylindrical body 34 by the actuation of the motor 36 and gear mechanism 38, the contacting pad 192*a* disposed on the side of one ring plate 190*a* comes into contact with the corresponding contact roller 200 of the limit switch and subsequently rotates the pressure detecting lever 196. When the lever 196 is rotated 90 degrees, the limit switch 194 changes the rotation of the outer shooting pipe 12 in an opposite direction.

The continued reverse rotation then causes the contacting pad 192*b* on the side of another ring 190*b* to contact with the corresponding contact roller 202 of the limit switch, and subsequently the limit switch 194 stops the reverse rotation after rotating the lever 198 90 degrees and starts the rotation of the rotating boom 40 in the previous or first direction.

In this manner, the shooting pipe is oscillated periodically by a predetermined rotating or oscillating angle.

In FIG. 1, the spray nozzle 14 which has its opening directed in a downward direction is oscillated a desired angle for applying the refractory material onto the inner upper portion of the furnace lining uniformly.

However it must be noted that the oscillating device of this invention provides the above oscillating movement of the shooting pipe regardless of the direction of the spraying opening of the spray nozzle.

Namely, when the inner lower portion of the furnace lining is required to be repaired, the spray nozzle 14 must be directed from the lower position to the upper position.

In this case, the supply of electricity to the limit switch 194 is first cut not to energize the limit switch 194 even when its contact roller comes into contact with the contact pad by the rotation of the outer shooting pipe 12. For facilitating the above rotation of the rotating boom 40 (outer shooting pipe 12) and also for preventing the breaking of the limit switch 194, the limit switch 194 is provided with two auxiliary pivot shafts 206 and 208 besides a common shaft 210 which pivotally joints the corresponding proximal ends of the two right-angled levers 196 and 198.

Each auxiliary pivot shaft 206 or 208 is constructed such that it allows only one-way pivoting to the pressure detecting lever.

Figure 25:
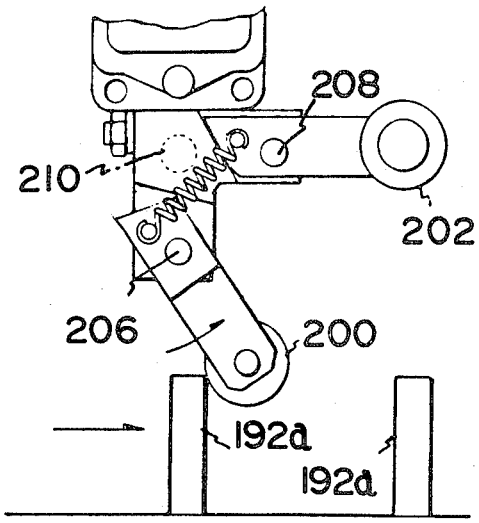
FIG. 25 is an explanatory view showing the above limit switch in operation.
Figure 26:
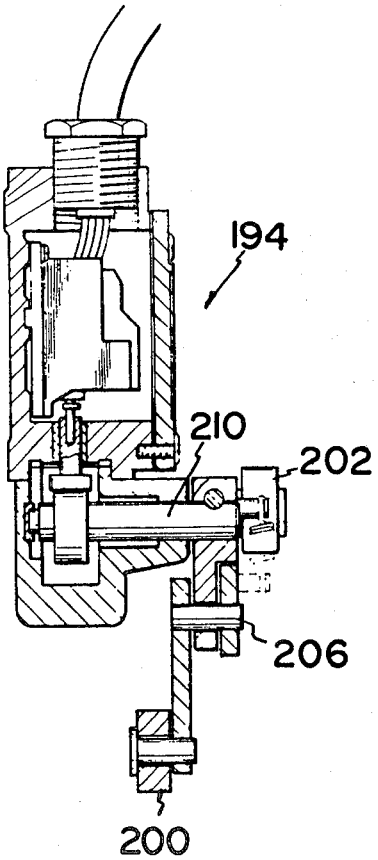
FIG. 26 is a cross-sectional of the limit switch taken along the line XI—XI of FIG. 23.
Figure 27:
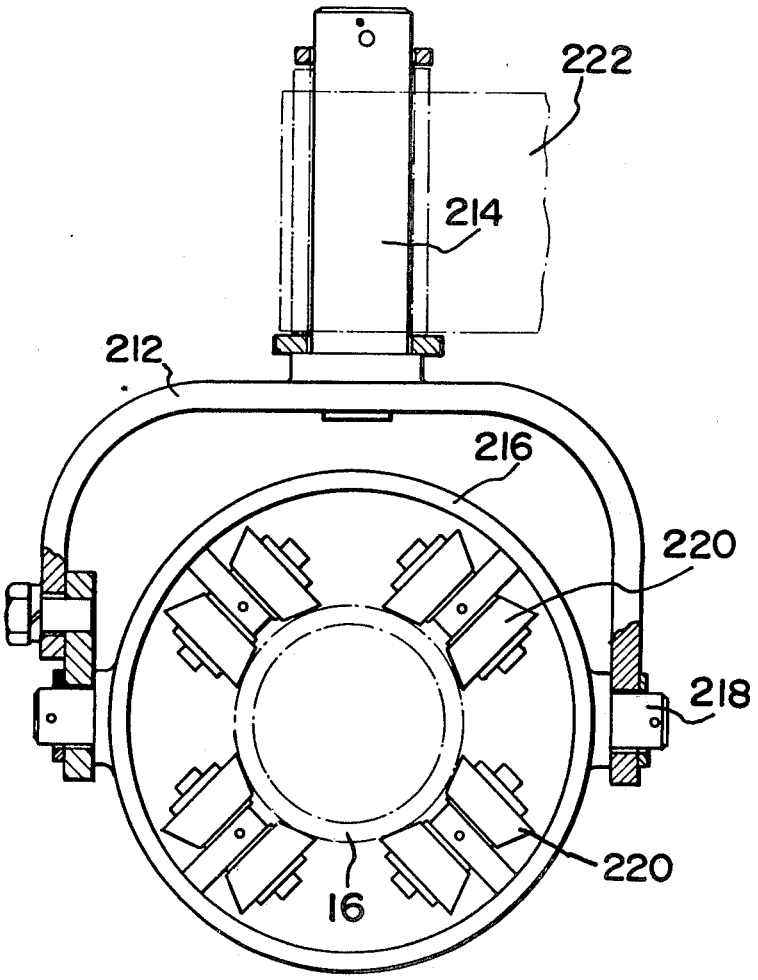
FIG. 27 is an enlarged front view of the hose-supporting mechanism employed in the apparatus of this invention.
Figure 28:
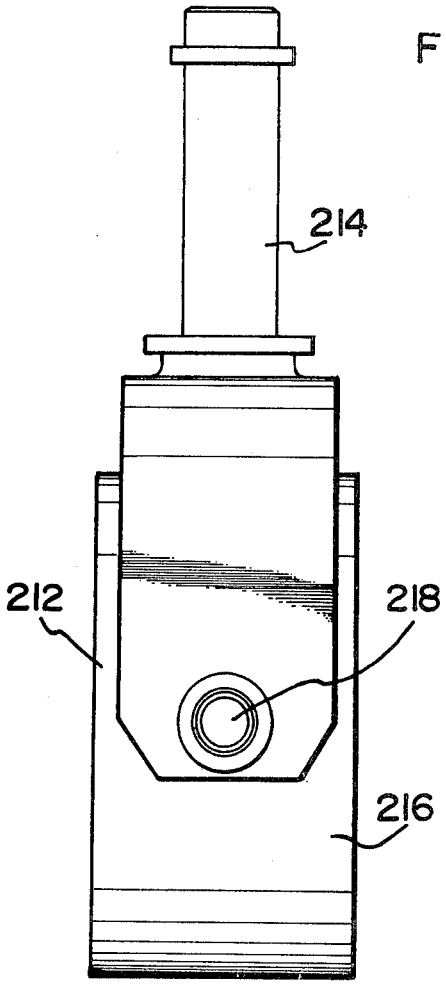
FIG. 28 is an enlarged side view of above hose-supporting mechanism.

Due to the above construction, even when the vertically disposed contact roller of the inoperative limit switch 194 is pressed rearwardly by the trains of contacting pads 192*a* on one side of the ring-like plate 190, the rotating boom 40 (the outer shooting pipe 12) is rotated without breaking the lever 196 since the rotation of the lever 196 on the auxiliary shaft 206 allows the advancement of the above contacting pads, as shown in FIG. 25.

Accordingly, since the shooting pipe of this invention is capable of oscillating besides rotating, tilting and sliding, the spraying operation by the lining apparatus of this invention is further enhanced.

(2) The Hose Supporting Mechanism

For preventing the flexible hose 16 from excessive slackening, the apparatus of this invention employs the hose supporting mechanism.

Figure 29:
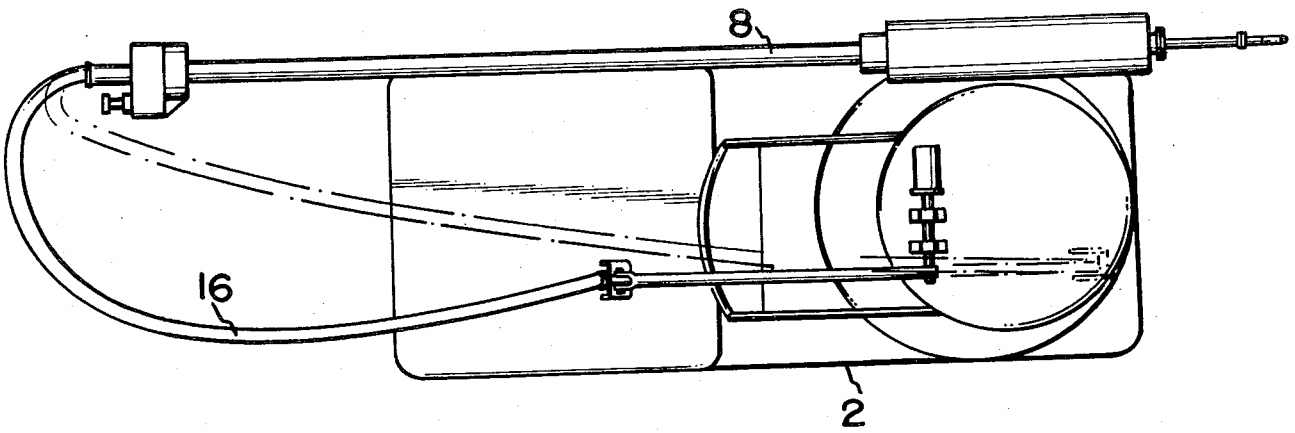
FIG. 29 is a plan view of the lining apparatus provided with a modified hose-supporting mechanism.
Figure 31:
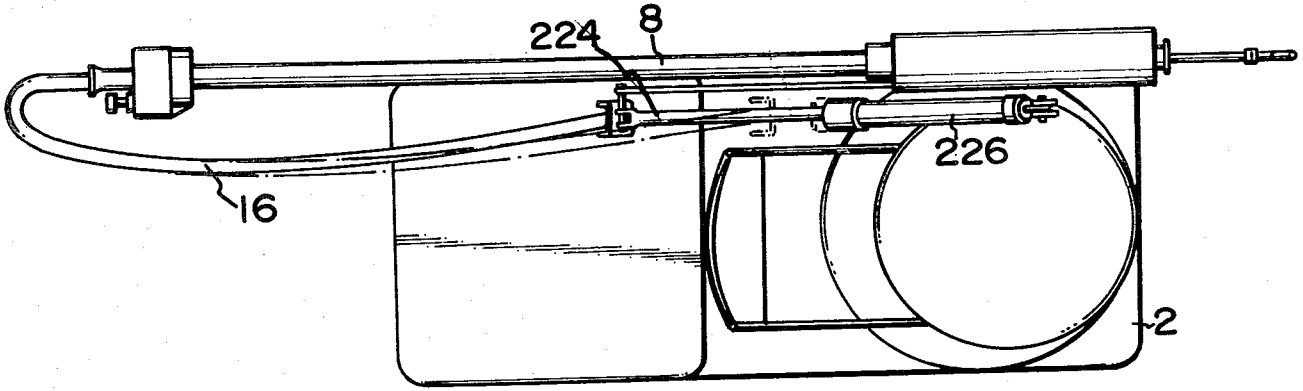
FIG. 31 is a plan view of the lining apparatus provided with another modified hose-supporting mechanism.
Figure 30:
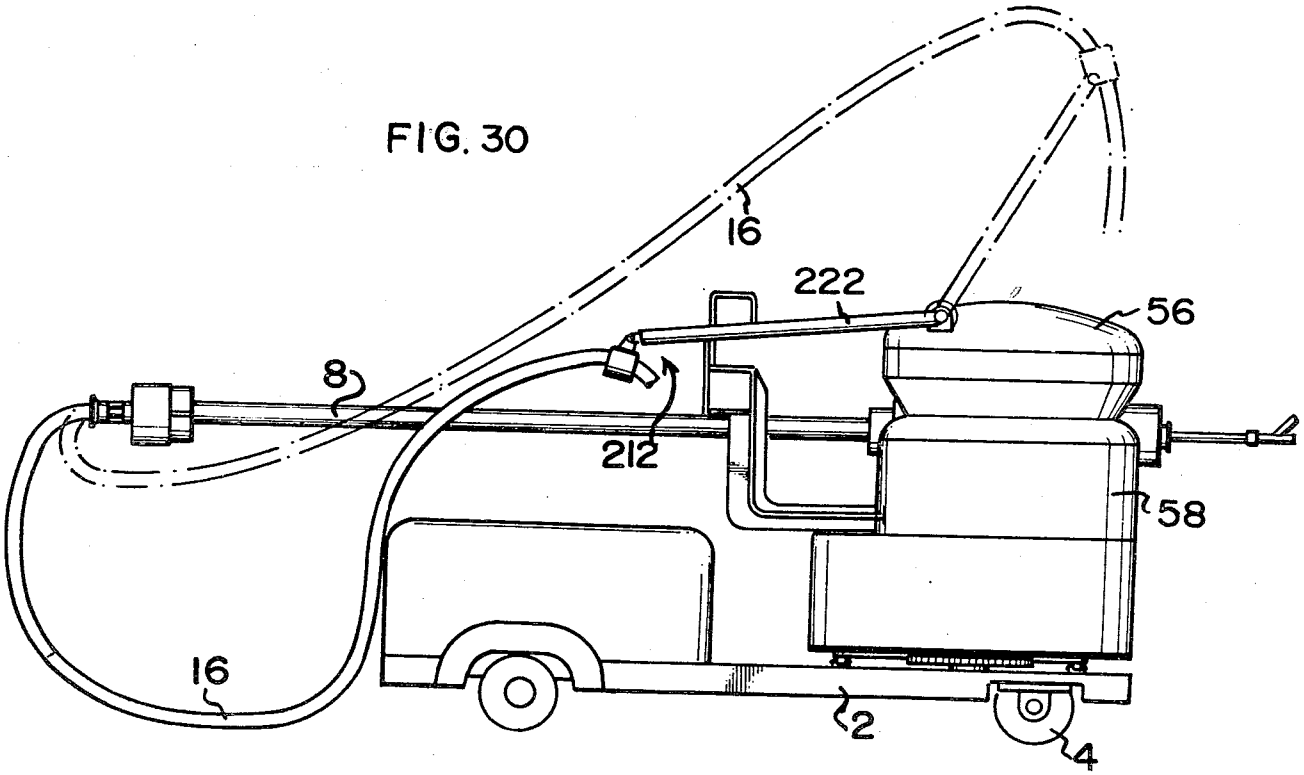
FIG. 30 is a side view of the above lining apparatus.
Figure 32:
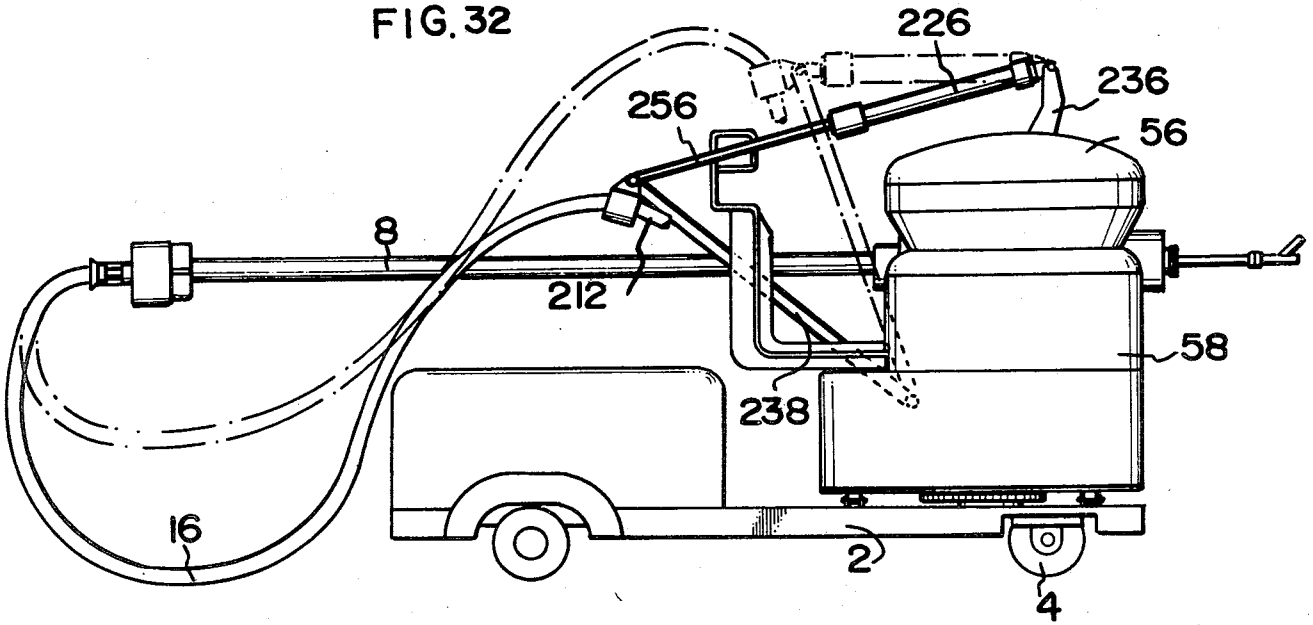
FIG. 32 is a side view of the above lining apparatus.

Three methods can be considered for such purpose, namely, (a) by swinging or rotating the flexible hose 16 horizontally in a widthwise direction relative to the apparatus as shown in FIG. 1 to FIG. 3, FIG. 27 and FIG. 28, (b) by swinging or rotating the flexible hose 16 vertically as shown in FIG. 29 and FIG. 30, or (c) by extending or retracting the flexible hose 16 in a lengthwise direction relative to the apparatus as shown in FIG. 31 and FIG. 32.

The hose supporting mechanism 211 is described hereinafter.

In the drawings, a bifurcated hanger means 212 provided with a rotary support shaft 214 thereon pivotally supports a cylindrical body 216 by journaling trunnion portions 218 of the cylindrical body 216. A plurality of rollers 220 which facilitate the smooth movement of the flexible hose 16 within the cylindrical body 216 are mounted on the inner peripheral wall of the cylindrical body 216 equidistantly. The rotary support shaft 214 is pivotally attached to the extremity of either a swinging arm 222 or of an actuating rod 224 of a hydraulic cylinder 226. The proximal end of the swinging arm 222 is fixedly secured to a vertical rotary shaft 228 which is rotated by a power-operated motor 230 by way of a gear mechanism 232 wherein the rotation of the rotary shaft 228 imparts the swinging movement to the arm 222 and the hose supporting mechanism 211.

The actuating rod 224 is extended or retracted by the actuation of the hydraulic cylinder 226 so as to impart the reciprocating movement to the hose-supporting mechanism 211. (Refer to FIG. 31 and FIG. 32).

Referring to other parts which facilitate the above swinging or reciprocating movement of the flexible hose 16, numeral 234 indicates bearings which rotatably support the vertical rotary shaft 228 (FIG. 32), numeral 236 indicates a support frame which is mounted on the top of the storage tank 56 and has the tap thereof pivotally connected with the distal end of the hydraulic cylinder 226, and numeral 238 indicates a guide lever which facilitates the smooth reciprocation of the actuating rod 224.

In the above construction, since the flexible hose 16 can pass through the cylindrical body 216 by way of a plurality of rollers 220 disposed around the inner peripheral wall of the cylindrical body 216 and the swinging arm 222 or actuating rod 224 which rotatably holds the cylindrical body 216 is given a swinging movement or reciprocating movement respectively, the middle portion of the flexible hose 16 can be supported by the hose supporting mechanism 211 such that the flexible hose 16 can be displaced in any direction at will in the air.

Furthermore, in each operation for controlling the shooting pipe 8, such as reciprocating, rotating or tilting, the hose 16 can retain the desired slacking sufficient to follow the above movement by displacing the supporting mechanism 211 to a position adjacent to a junction where the shooting pipe 10 and the flexible hose 16 meet. The above displacement of the hose-supporting mechanism 211 is especially effective in the reciprocating movement of the shooting pipe 8 wherein the inner shooting pipe 10 slides within and relative to the outer shooting pipe 12 while the outer shooting pipe 12 moves within and relative to the rotatable boom 40 of the cylindrical body 34.

When the lining apparatus (including the transport car 2) is to be moved after the completion of a repair operation, the flexible hose 16 can be prevented from excessive slackening by displacing the supporting mechanism 211 away from the above hose connection whereby the laying down of the flexible hose 16 onto the floor which hampers the movement of the transport car can be avoided or obviated.

Accordingly, since the excessive slackening can be adsorbed by the hose-supporting mechanism 211 of simple construction, the transport car 2 can move to any desired location without trouble caused by the flexible hose 16 and can be constructed as small as possible for facilitating the entry and working of the lining apparatus in a narrow working space.

(3) Devices for measuring the thickness of the furnace lining

The apparatus of this invention is further provided with three devices which measure the horizontal rotating angle, the tilting angle and the reciprocation distance of the shooting pipe, respectively, whereby the thickness of the furnace lining can be measured with great accuracy resulting in the effective repair operation of the furnace lining.

In general, before applying refractory material onto the abraded portion of a furnace lining, the thickness of the furnace lining is checked to determine the degree of wear and abrasion of the furnace lining. Conventionally, however, this checking is done by a skilled operator who determines the thickness of the furnace lining using his past experience of observing the inside of a furnace.

Therefore, refractory material applied in the above way results in an irregular surface and an inaccurate repair operation.

This invention provides an apparatus for repairing a furnace lining which resolves the aforementioned defects, such that the apparatus facilitates the easy and correct measuring of the lining thickness which is of vital importance to the furnace lining operation which follows.

Such measuring devices are clearly shown in FIG. 1 to FIG. 3. However, before describing the measuring devices shown in FIG. 1 to FIG. 3 in detail, the basic principles and structures of the measuring devices are first described in conjunction with the attached drawings, FIG. 33 through FIG. 40.

Figure 33:
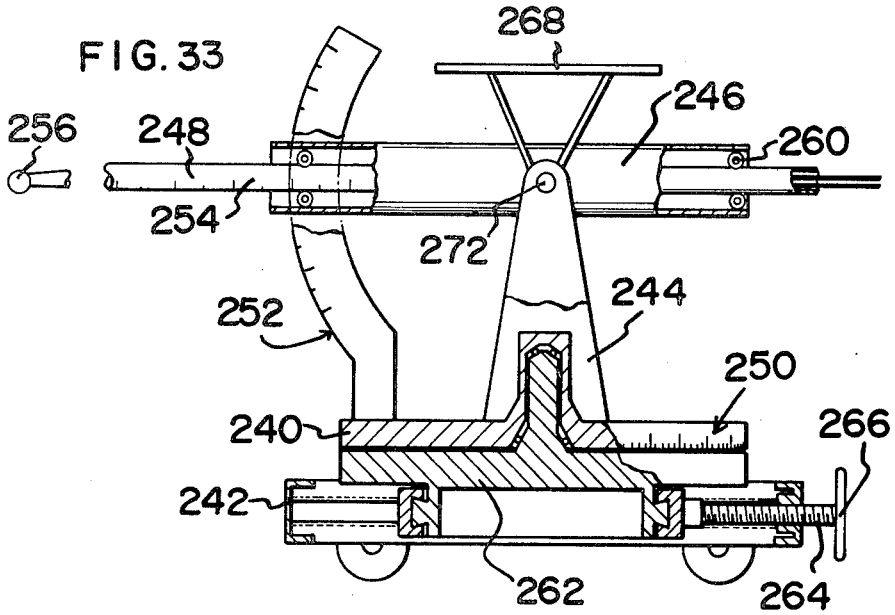
FIG. 33 is a side view with a part broken away of a measuring car mounted with measuring devices which is provided for the explanation of the operation of measuring devices.
Figure 34:
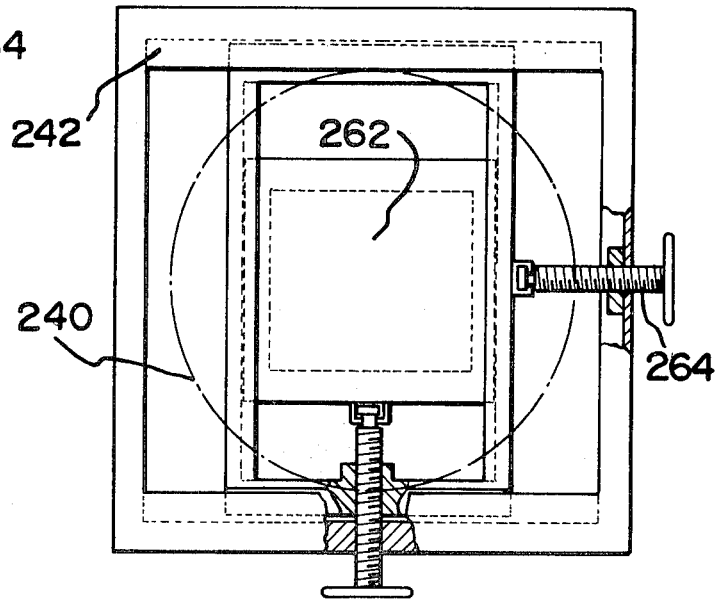
FIG. 34 is a plan view of the above measuring car.

FIG. 33 shows a simplified and basic structure of the apparatus with which the basic measuring principle is described hereinafter.

In FIG. 33, a turntable 240 is rotatably mounted on a transport car 242. On the turntable 240, a vertical column 244 which pivotally supports a cylindrical body 246 at the top thereof is fixedly mounted. An elongated bar 248 is slidably disposed within the cylindrical body 246 such that the bar 248 can be extended toward or away from the furnace within the tiltable cylindrical body.

Three measuring devices, namely, a first measuring device 250 which measures the horizontal rotating angle ($\alpha$) of the turntable 240, a second measuring device 252 which measures the tilting angle ($\beta$) of the cylindrical body 246 and a third measuring device 254 which measures the reciprocation distance or length (X) of the elongated bar 248 are respectively mounted at suitable positions on the repair apparatus. Each measuring device is provided with a desired scale thereon.

Referring to other parts of the basic apparatus, numeral 256 indicates a contactor which is secured to the front extremity of the elongated bar 248 and comes into contact with the abraded surface of a furnace 258, numeral 260 indicates guide rollers which facilitate the smooth longitudinal movement of the elongated bar 248 relative to the cylindrical body 246, numeral 262 indicates a slide frame which is slidable in both lengthwise and widthwise directions relative to the transport car 242, numeral 264 indicates screw arrangements which regulate the lengthwise and widthwise sliding movement of the slide frame 262 relative to the transport car 242, numeral 266 indicates operating handles by which screw arrangements 264 are actuated, numeral 268 indicates a light-receiving table which receives the light emitted from a projector 270 mounted in the ceiling of a furnace room to detect the accurate position of the turntable 240 and numeral 272 indicates a pivot shaft which works as a fulcrum to tilt the cylindrical body 246.

The manner in which the above measuring apparatus is operated is described.

Figure 35:
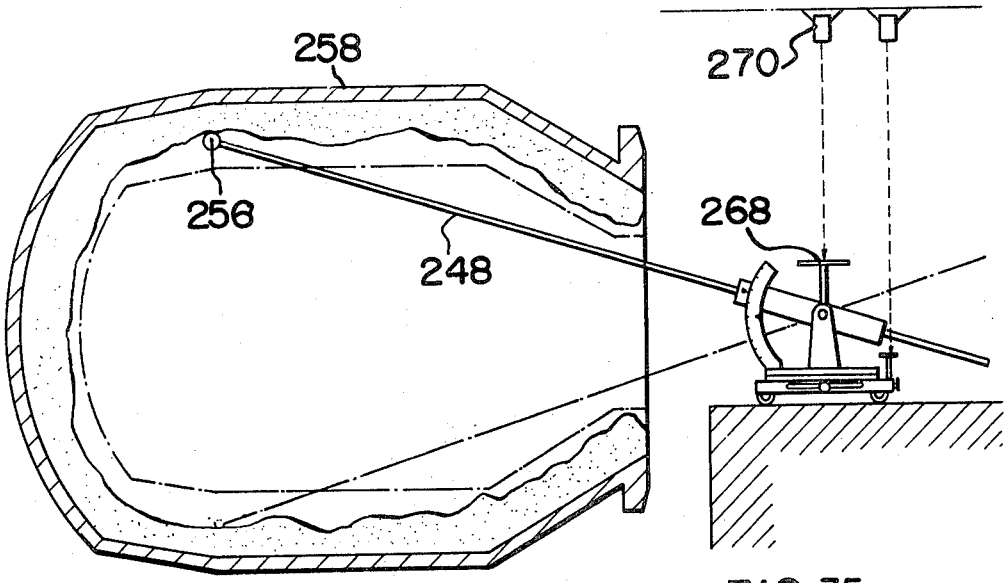
FIG. 35 is an explanatory view showing the above measuring car measuring the wall thickness of a furnace.
Figure 36:
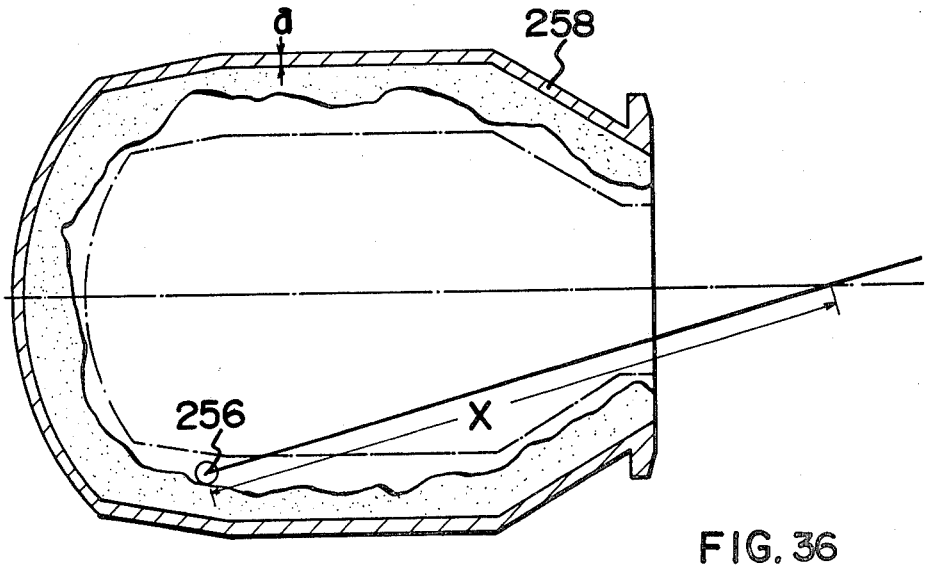
FIG. 36 is another explanatory view showing the length (X) of the elongated bar extended into the furnace.

The furnace 258 is tilted until it reaches the horizontal position as shown in FIG. 35. Subsequently the transport car 242 is moved to a position adjacent to the opening of the furnace 258.

With the rotation of the turntable 242, the tilting of the cylindrical body 246 on the pivot shaft 272 and the reciprocation of the elongated bar 248, the contactor 256 which is secured to the front extremity of the elongated bar 248 comes into contact with the desired portion of the furnace lining.

When the contacting of the contactor 256 with the furnace lining is affirmed, the rotating angle ($\alpha$) of the turntable 240, the tilting angle ($\beta$) of the cylindrical body 246 and the longitudinal sliding length (X) of the elongated bar 248 are measured by reading the scales of the respective devices. In this case, since the thickness of the outer peripheral wall of the furnace 258 is predetermined at the time the furnace 258 is located in a desired position, the thickness of the wall including the lining thickness can be calculated readily by either a calculator or a computer.

One example is described hereinafter for calculating the thickness of the furnace wall 258.

$$\overline{QP}=X$$

$$\overline{QQ'}=X_{\sin\beta}$$

$$\overline{Q'P}=X_{\cos\beta}$$

$$\overline{Q'Q''} = X_{\sin\alpha\cos\beta}$$

Namely, $$\begin{aligned}\overline{QQ''^2} &= QQ'^2 + Q'Q''^2 \\ &= X^2(\sin^2\beta + \sin^2\alpha\cos^2\beta) \\ &\leqq X^2(1 - \cos^2\alpha\cos^2\beta)\end{aligned}$$

Accordingly, $$\overline{QQ''} = X\sqrt{(1-\cos^2\alpha\cos^2\beta)}$$

$$\text{Thickness of furnace wall } Z = a - b - QQ'' \\ a - b - X\sqrt{1 - \cos^2\alpha\cos^2\beta}$$

where:

X: the length between the pivot shaft 272 (point P) (slide length) and the center of the contactor 256 (point Q), b: the radius of the spherical contactor 256, Z: the thickness of the furnace wall, Q'': the crossing point of the perpendicular, from the pivot shaft 272 or the point Q (on the axis of the furnace) to the axis of the furnace, with the axis of the furnace, Q': the crossing point of the perpendicular from the horizontal plane (tilting angle 0 degree) on which the center (Q) passes with the horizontal plane, a: the inner radius of the iron or steel furnace wall.

In the above case, the inner radius (a) of the furnace and the radius (b) of the spherical contactor 256 are known at the designing stage while the rotating angle ($\alpha$), the tilting angle ($\beta$) and the sliding length (X) can be obtained by measuring devices 250, 252 and 254. By introducing the values obtained in the above way into the last formula, the thickness (Z) of the furnace wall can be readily calculated.

In the above formula, the elongated bar 248 is treated as a rigid body. However, in the actual calculation of the wall thickness, the deflection of the elongated bar 248 must be taken into account.

Figure 40:
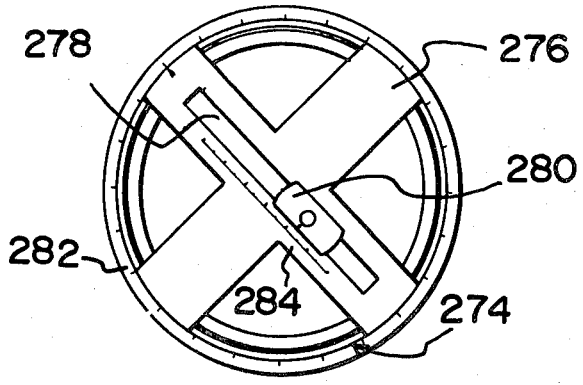
FIG. 40 is an explanatory view showing the movement of the cruciform plate and the collar within the ring-like structure of the above modified measuring car.

The modification of the basic structure is described hereinafter in conjunction with FIG. 38 through FIG. 40.

The device of this modification substantially has the same construction as that of the basic structure described previously with the exception of the three measuring devices.

In the drawings, a ring-like frame structure 274 is mounted on the transport car 242 in front of the cylindrical body 246. An arcuate cruciform rotary plate 276 is rotatably mounted on the ring-like frame structure 274 having four edges rotatably engaged with the front periphery of the ring-like frame structure 274 in a dovetail arrangement.

An elongated opening 278 is formed in either beam of the above cruciform plate 276 within which a collar 280 is slidably disposed such that the collar 280 slides along the opening in the beam. The elongated bar 248 which is slidable within the cylindrical body 246 is also slidable within the collar 280. The ring-like frame structure 274 is provided with a scale or readings on the front periphery thereof to enable a first measuring device 282 to determine the rotating angle ($\alpha$).

Other readings are provided on the cruciform plate 276 along the elongated opening 278 to enable a second measuring device 284 to determine the tilting angle ($\beta$) while still other readings are provided on and along the elongated bar 248 to enable a third measuring device 286 to determine the slide length (X).

Figure 39:
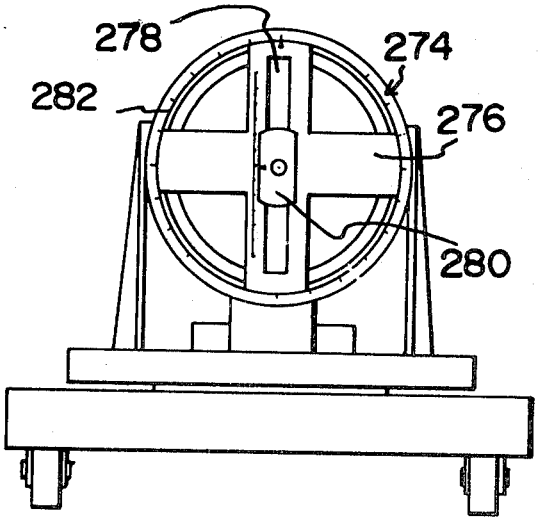
FIG. 39 is a front view of the above modified measuring car.

Due to the above construction, corresponding to the movement of the elongated bar, the collar 280 and cruciform rotary plate 276 are displaced over the opening-formed beam of rotary plate 276 and the ring-like frame structure 274 respectively, and when the contactor 256 attached to the front extremity of the elongated bar 248 comes into contact with a portion of the inner furnace lining, collar 280 and rotary plate 276 take positions shown in FIG. 39. Subsequently, the rotating angle ($\alpha$) of the rotary plate 276 and the tilting angle ($\beta$) of the cylindrical body 246 are determined by reading the scale on the ring-like frame 274 and the scale on the rotary plate 276 respectively.

By introducing values of ($\alpha$), ($\beta$) and (X) into the previously mentioned formula, the wall thickness can be readily measured.

In the drawings, numeral 288 indicates a slide frame which corresponds to the slide frame 262 of the first basic structure and on which the support column 244, the turntable 240 and the ring-like frame structure 274 are mounted.

The lining apparatus for repairing the furnace lining which is provided with the above-mentioned measuring devices is disclosed hereinafter in conjunction with the attached drawings FIG. 1 through FIG. 3.

In the drawings, the measuring device for determining the horizontal rotating angle ($\alpha$) of the turntable 46 comprises an arcuate scale plate 290 having its radial center on the axis of the turntable 46, a center mark 292 which is provided on the storage tank 56 in alignment with the axis of the turntable 46 and a projector 294 which is mounted on the ceiling of a furnace room and which projects the light toward the above arcuate plate 290.

In the above construction, the horizontal rotating angle ($\alpha$) can be determined by reading the scale of the arcuate scale plate 290 on which a spot-like light projected from the projector 294 falls.

The measuring device for determining the tilting angle ($\beta$) comprises an arcuate scale plate 296 vertically mounted on the side of the storage tank 56 and an arrow-shaped pointer 298 mounted on the corresponding side of the rotating boom 40.

The measuring device for determining the slide length (X) of the shooting pipe 8 consists of a scale 300 provided on and along the flexible hose.

The measuring devices mounted on the lining apparatus of this invention determine respective values as follows.

When the cylindrical body 34 is tilted by the actuation of the hydraulic cylinder 48, the tilting angle ($\beta$) of the cylindrical body 34 can be measured by reading the scale on the scale plate 296 indicated by the pointer 298.

The rotating angle ($\alpha$) of the turntable can be measured by the position of the spot light projected onto the arcuate scale plate 290.

The slide length (X) of the shooting pipe 8 or the contactor 256 attached at the extremity of the pipe 8 is measured by the scale 300 provided on the flexible hose 16.

By introducing values ($\alpha$), ($\beta$) and (X) into the suitable calculator or computer the wall thickness of the furnace can be readily determined.

As has been described heretofore, the embodiment of this invention has the following advantages.

Corresponding to the rotation of the turntable 46, the tilting of the cylindrical body 34 and the sliding of the shooting pipe 8 (or elongated bar 248), the wall thickness can be mechanically and readily determined with great accuracy.

(4) Heat-resistant Window

The lining apparatus of this invention further includes a heat-resistant window 302 which is provided in front of the steering seat 166 such that the operator can observe and conduct the spraying operation without subjecting himself to high radiation heat from the furnace.

Figure 42:
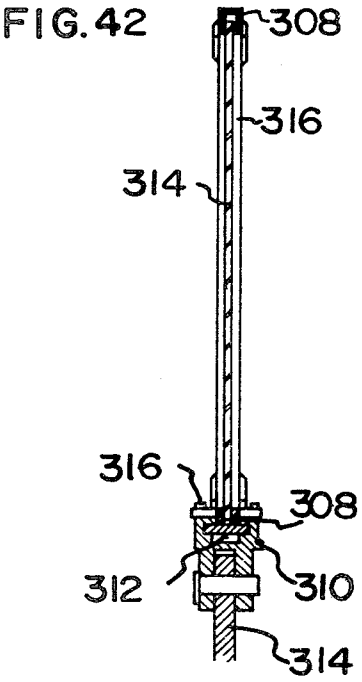
FIG. 42 is a cross-sectional view of the above window taken along the line XII—XII of FIG. 41.
Figure 41:
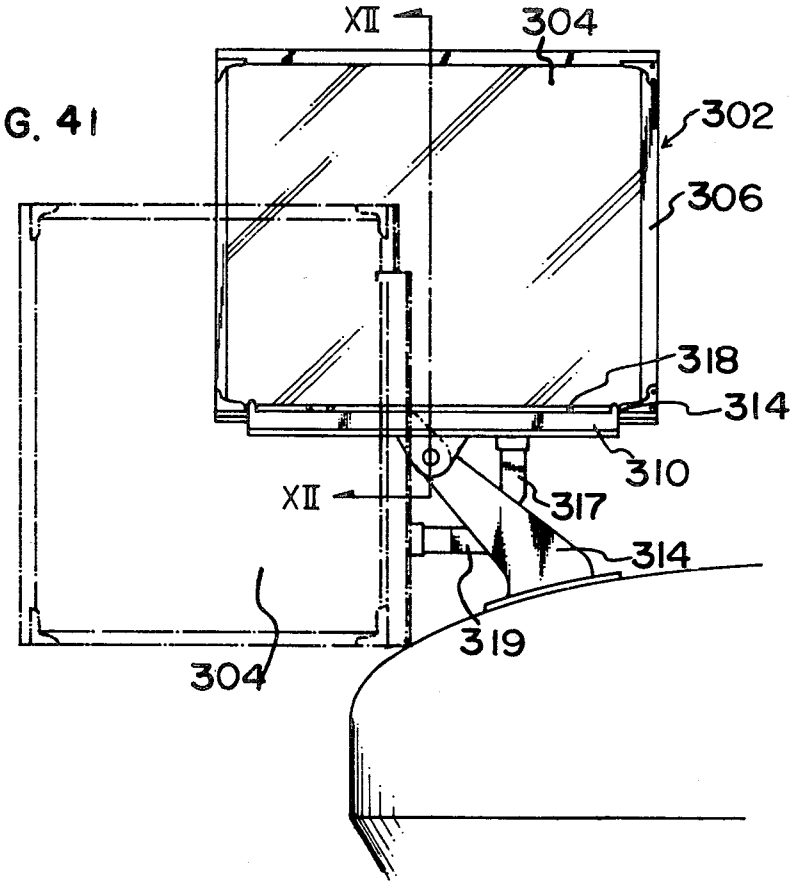
FIG. 41 is a front view of the heat-resistant window.

In the drawings, FIG. 41 and FIG. 42, a heat-resistant glass pane 304 is disposed within a window frame 306 by way of cushion means 308. A base frame 310 is provided with an elongated groove 312 which slidably receives the bottom of the window frame 306. This frame has the central portion pivotally mounted on the top of an inclined support frame 314 which, in turn, is mounted on the top of the storage tank 56.

The above pivotal connection provides the rotation of the heat-resistant window 302.

At each upper longitudinal side of the base plate 310, two spaced-apart stoppers 316 are provided and these stoppers 316 prevent the excessive sliding of the window frame 306 relative to the base frame 310 together with protrusions 318 formed onto window frame 306 that are provided.

For the purpose of defining the rotating angle of the window frame 306 at approximately 90 degrees, vertical and horizontal stoppers 317 and 319 are secured to the sides of the inclined support frame.

Due to the above construction, the heat-resistant window 302 of this invention has the following advantages:

(1) The window protects the operator from heated slag or refractory material splashed from the furnace and from the radiation heat, assuring the safety of the spraying operation.

(2) Since the heat-resistant cushion material such as glass wool is positioned between the window frame and the heat-resistant window glass, the thermal stress which occurs due to the difference in expansion rate between the window frame and the window glass can be absorbed into the cushion material, thereby preventing the breaking of the window pane.

(3) Since the window frame is slidable relative to the base frame and is also pivoted 90 degrees on the top of the inclined support frame, the observation area that the heat-resistant window of this invention covers can be widened.

(4) If the heat-resistant glass is formed of duplicate construction, the window further enhances the safety of the spraying operation and the heat-resistant effect.

Glass which absorbs ultraviolet rays or infrared rays can also be employed.

(5) System for Automatically Unclogging the Spray Nozzle

As has been described heretofore, the refractory material in a powder-like form is charged into the storage tank 56. This charged refractory material is discharged from the bottom outlet 66 thereof and subsequently the flow amount of the refractory material is regulated by the flow regulating valve 68. Then the regulated amount of refractory material is supplied into the shooting pipe 8 by way of the flexible hose 16 with the aid of the air gun 74 which imparts flow energy to the refractory material. The water stored in the storage tank 58 is supplied into the shooting pipe 8, which is subject to high radiation heat, through the cooling water supply tube 22 and the warmed water produced after cooling the shooting pipe 8 is charged into the middle portion of the flexible hose 16 so that the refractory material in a dry form is mixed with the warmed water. Finally, the refractory material which is now in a wet-slurry form is sprayed from the spray nozzle 14 and is applied onto an abraded portion of the furnace lining.

Figure 43:
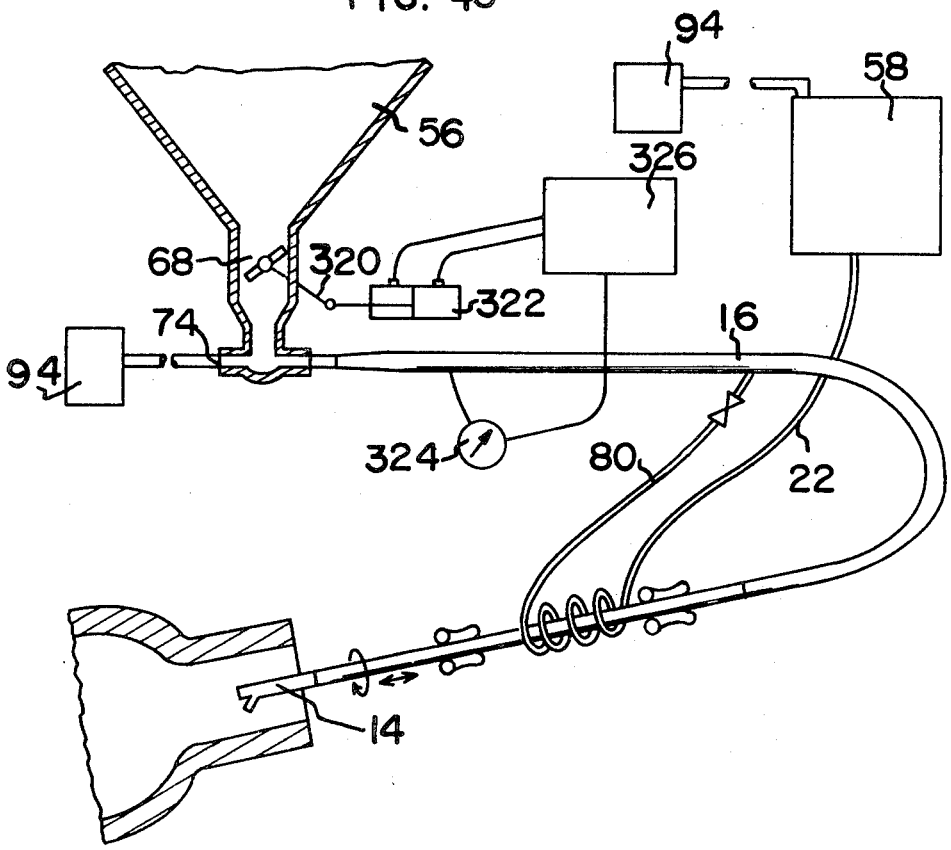
FIG. 43 is an illustrative view of the system for unclogging the spray nozzle or shooting pipe which is provided for the lining apparatus of the fifth embodiment.
Figure 44:
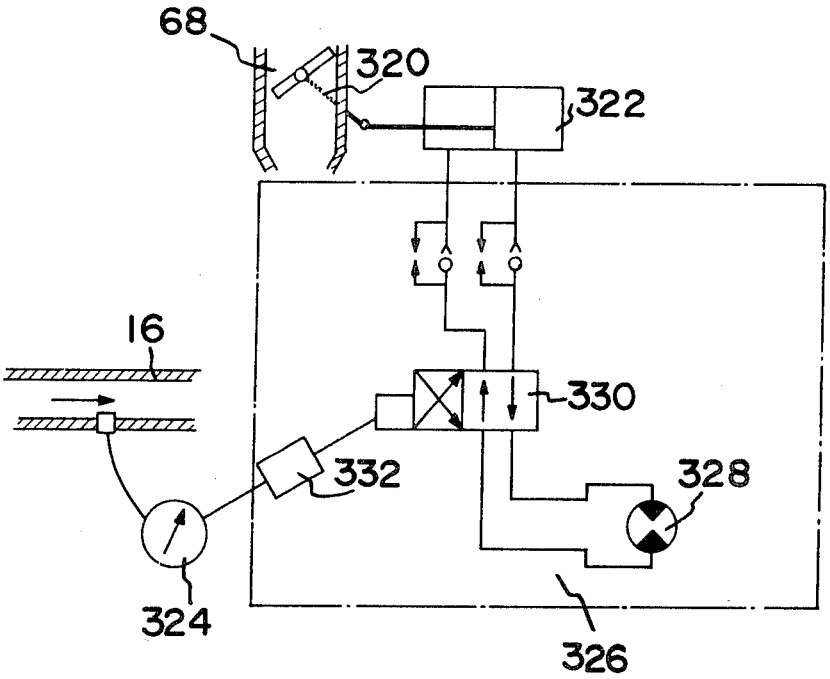
FIG. 44 is an enlarged explanatory view of regulating means which is employed in the above system for regulating the opening of the flow regulating valve.

The recovery system of this invention is constructed as shown in FIG. 43 and FIG. 44.

A connecting lever 320 has one end connected to the flow regulating valve 68 and the other end connected to a hydraulic cylinder 322.

A pressure gauge 324 is mounted at the middle of the flexible hose 16 which detects the supply pressure within the flexible hose 16.

The unusally high pressure detected by the above gauge 324 is signalled to a regulating means 326 to regulate the actuation of the hydraulic cylinder 322.

An air compressor 94 is also provided in the system which supplies the compressed air into the air gun 74 and the water storage tank 58.

The regulating means 326 is composed of a hydraulic pump 328, a solenoid valve 330 and a pressure-electricity converter 332 which converts a pressure signal to an electric signal.

In the above system, when the spray nozzle 14, the shooting pipe 8 or the flexible hose 16 is clogged with refractory material, the pointer of the pressure gauges 324 shows an unusually high supply pressure. The thus detected pressure signal is converted into an electric signal by the converter 332 which accordingly energizes the solenoid valve 330.

When the solenoid valve 330 is energized, the actuating rod of the hydraulic cylinder 322 moves to close the flow regulating valve 68, the clogged portion becomes directly subject to the compressed air and compressed water whereby the clogging material is discharged along with the above two compressed flows from the spray nozzle 14 whereby the clogging is eliminated.

By eliminating the clogging, the supply pressure within the flexible hose 16 returns to a normal level and the pressure gauge 324 transmits the normal pressure signal to the converter 332 which converts the pressure signal to the electric signal. This electric signal energizes the solenoid valve 330 and the energization of the solenoid valve 330 actuates the hydraulic cylinder 322 such that the hydraulic cylinder 322 rotates the lever 320 in a direction to open the flow regulating valve 68. Accordingly the flow regulating valve 68 recovers to a normal operating position and the refractory material in a desired amount is charged into the flexible hose 16 thereafter.

Accordingly the system for adjusting the spraying operation automatically eliminates clogging of refractory material within the spray nozzle 14, the shooting pipe 8 or the flexible hose 16 without stopping the spraying operation.

Referring to the above-mentioned flow regulating valve 68, it has the following construction.

Figure 45:
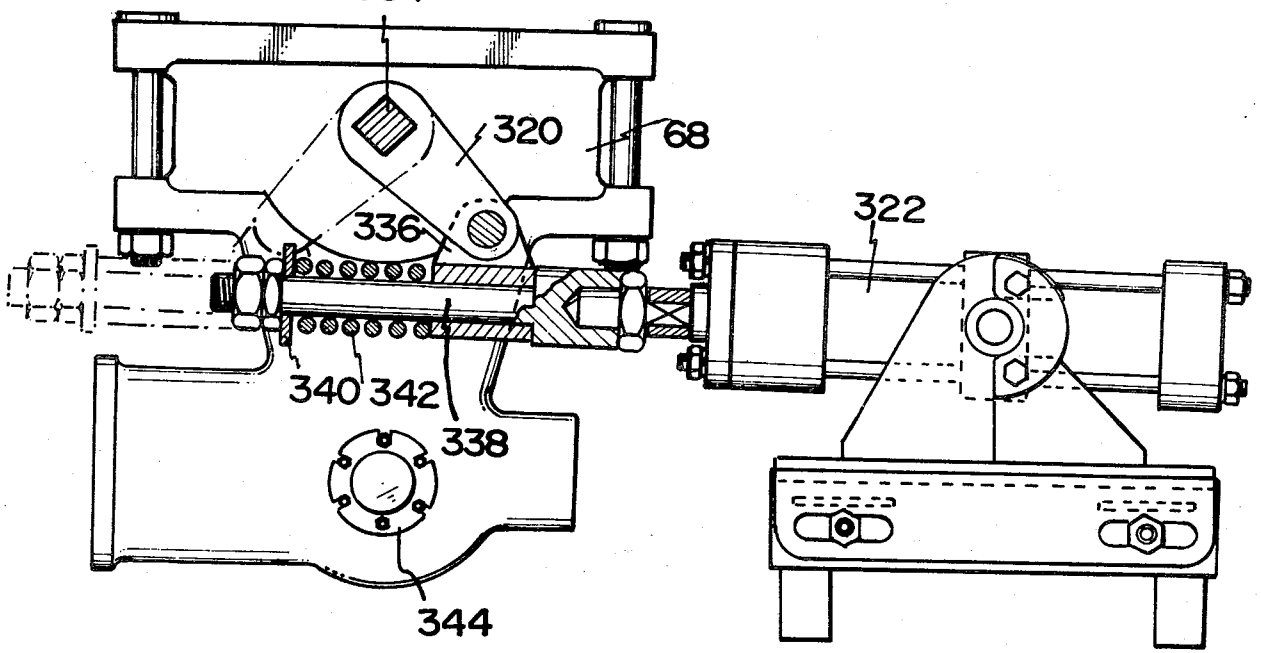
FIG. 45 is an enlarged side view of the above flow regulating valve.
Figure 46:
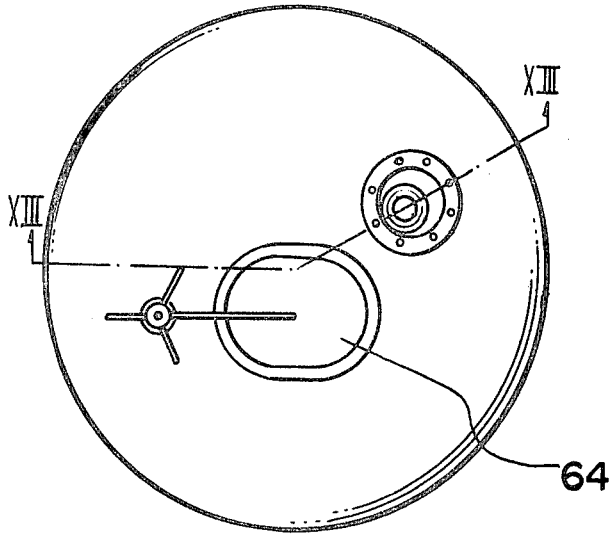
FIG. 46 is a plan view of the storage tank of the apparatus showing especially the refractory material agitating means mounted therein.
Figure 47:
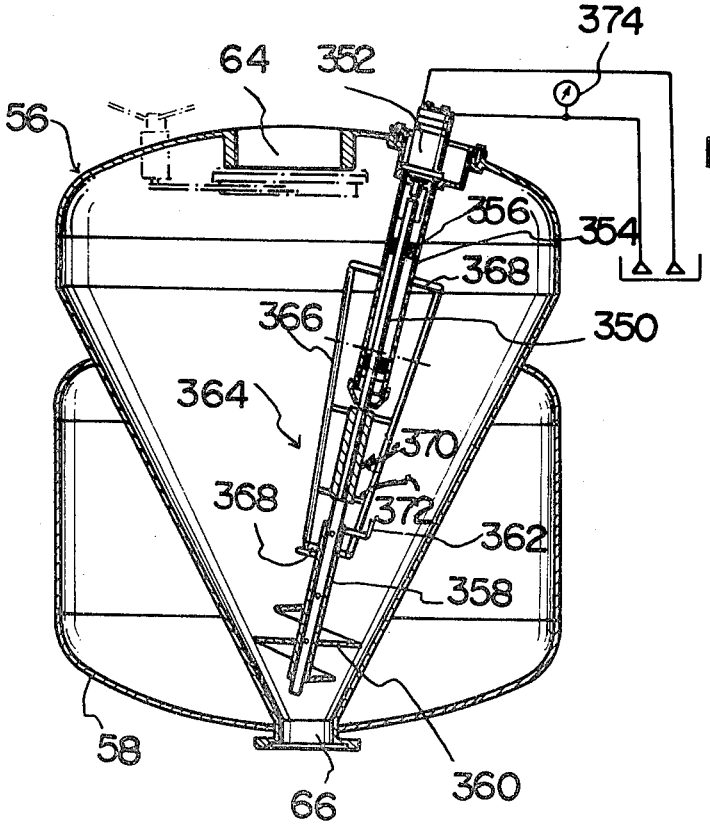
FIG. 47 is a longitudinal cross-section view of above storage tank taken along the line XIII—XIII of FIG. 46.
Figure 48:
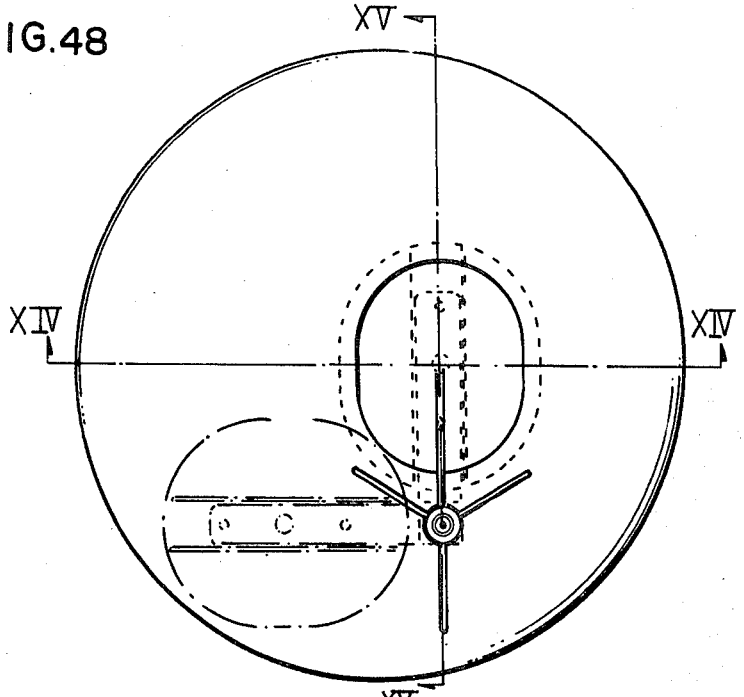
FIG. 48 is a plan view of the storage tank of the above apparatus showing especially the lid means mounted thereon.
Figure 49:
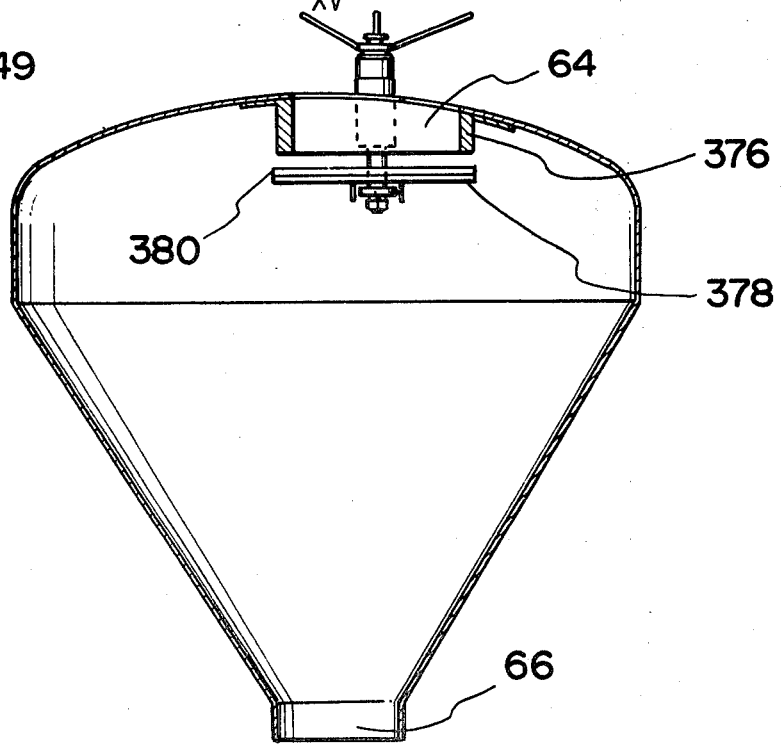
FIG. 49 is a longitudinal cross-sectional view of the above storage tank taken along the line XIV—XIV of FIG. 48.
Figure 50:
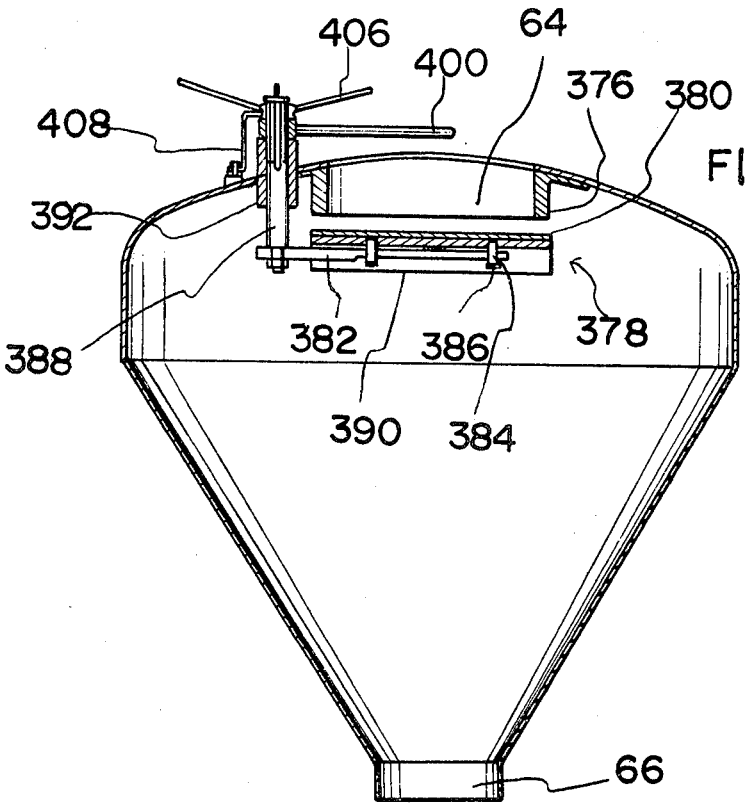
FIG. 50 is another longitudinal cross-sectional view of the above storage tank taken along the line XV—XV of FIG. 48.
Figure 51:
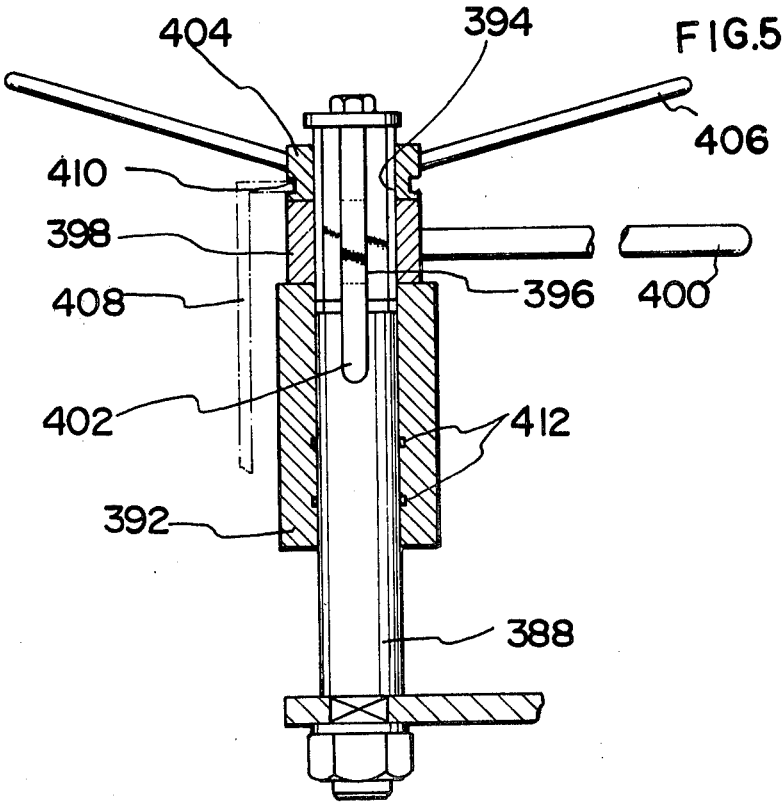
FIG. 51 is an enlarged cross-sectional view of above lid means showing especially the mechanism to open the lid means.

In FIG. 8 and FIG. 45, the throttle plate 70 is fixedly mounted on a transverse rotating shaft 334 which, in turn, has one end thereof secured to the proximal end of the operable lever 320. The distal end of the lever 320 is pivotally connected with a pivoting sleeve 336 within which an actuating or reciprocating rod 338 of the hydraulic cylinder 322 is slidably disposed. A stopper 340 is secured to the front portion of the actuating rod 338 at a position apart from the pivoting sleeve 336 and a compression spring 342 is disposed between the stopper 340 and the pivoting sleeve 336 such that it absorbs the excessive torque exerted by the actuation of the hydraulic cylinder 322.

The compression spring 342 can be replaced by any suitable means which has the same function such as a plate spring, hydraulic or pneumatic shock absorber.

In general, when trouble occurs, such as clogging of the refractory material in the valve 68 or in the middle of the flexible hose 16, or an intrusion of foreign material into the valve 68, the flow regulating valve 68 of this invention is prevented from rotating thereof without causing the breakage of any parts of the valve 68. Namely, in the above case, even when the actuating rod 338 is retracted in a direction to close the valve 68, the operable lever 320 which is secured to the rotating shaft 334 and the pivoting sleeve 336 do not move since the retraction of the actuating rod 338 is absorbed due to the compression of the spring 342 disposed between the lever 320 and the stopper 340.

Accordingly, since excessive torque which is caused by the reciprocating movement of the actuating rod 338 is absorbed by the compression spring 342, the breakage of the rotating shaft 334 can be obviated.

Referring to other parts of the flow regulating valve 68, an observation window 344 which facilitates the easy observation of the flow of the refractory material passing through the valve 68 is provided on the spherical side wall of the valve 68. This window 344 is also replaceable so that the jet gun 74 which may be clogged by refractory material is easily unclogged. Of course, the window 344 can be made of steel plate if it is used for only removing the material clogged in the bottom portion adjacent to the jet gun 74.

(6) The Refractory Storage Tank

The storage tank 56, which is usually subject to a desired pressure therein, has a charging inlet 64 at the top thereof and a discharge outlet 66 at the bottom thereof. Within the tank 56, a vertical rotary shaft 350 is disposed in a slightly inclined position with the upper end thereof fixedly connected to a rotating device 352 such as a hydraulic motor which, in turn, is mounted at the top of the storage tank 56. The hydraulic motor 352 rotates the rotary shaft 350 at a constant speed or velocity. The upper half portion of the rotary shaft 350 is kept air-tight by a hollow sleeve 354 due to bearings 356 disposed at both ends of the sleeve 354.

A hollow tube 358, which is provided with a fixed helicoid blade 360 on the outer periphery thereof, is mounted on the lower portion of the rotary shaft 350, which is substantially below the lower end of the sleeve 354. The lower end of the rotary shaft 350 is directed toward the discharge outlet 66 of the storage tank 56. The hollow tube 358 has a crusher bar 362 attached at the upper end thereof which prevents the formation of a refractory material bridge within the storage tank 56.

The rotary shaft 350 is further provided with an axially extending resistance structure 364 which is substantially made of two axial bars 366, a semi-circular top and end connecting bars 368 and a hollow shaft 370 secured to the rotary shaft 350 and intermediate bars 372 which connects axial bars 366 and top and low bars 368 to the rotary shaft.

In the above construction, a pressure gauge 374 is connected to the middle of the hydraulic motor 352 and this gauge 374 indicates the change in the resistance pressure received by the resistance structure 364. In other words, the pressure gauge 374 is used to indicate the amount of refractory material within the tank 56 by measuring the pressure resistance.

When an electric-power operated motor is used as the rotating device 352, the change in resistance can be indicated as a change in either electric current or voltage and the amount of refractory material within the tank 56 can be measured as in the case of the pressure gauge 374.

Due to the above construction, when the rotary shaft 350 and the corresponding helicoid blade 360 are rotated, the downward movement of the refractory material adjacent to the discharge outlet 66 of the storage tank 56 is accelerated whereby the arching or bridging phenomenon which prevents the smooth discharge of the refractory material can be prevented.

Furthermore, since the resistance structure 364 which is disposed around and along the axis of the rotary shaft 350 is attached to the rotary shaft 350, the resistance structure 364 is rotated while receiving the resistance of refractory material contained in the storage tank 56. Namely, when the tank 56 contains a substantial amount of refractory material therein, the resistance structure 364 has its entire surface subject to the resistance of refractory material so that the load that the hydrualic motor 352 receives by way of the resistance structure shows a high value. When the amount of refractory material in the tank 56 is decreased, the load shows a low value.

Since the hydraulic motor is of a constant-volume-type and therefore always rotates at a constant speed, the change in the load can be indicated as a change in pressure.

Accordingly, if the indication of the pressure gauge 374 is predetermined such that it corresponds to the change in the load of the hydraulic actuator, the amount of refractory material within the tank 56 can be determined easily.

Therefore, due to the above construction, the refractory material can be distributed constantly and the amount of refractory material in the tank 56 can be determined precisely thereby eliminating the necessity of checking the amount of refractory material within the storage tank and thereby enabling the prediction beforehand of unexpected accidents, such as an interruption in the lining operation.

The storage tank 56 for refractory material is further provided with a specially-devised lid means which horizontally opens or closes the inlet for charging refractory material.

Around the periphery of the charging inlet 64, a ring seat 376 is attached and the above lid means 378 moves towards or away from the bottom surface of the ring seat 376. The lid 378 has a packing 380 on the entire upper surface thereof while the lid 378 has its lower end secured to a supporting arm 382 by fastening pins 384 and snap rings 386. The proximal end of the supporting arm 382 is fixedly connected with the lower end of a vertical support shaft 388 which is disposed vertically at the periphery of the charging inlet 64.

Furthermore, a center-pressing means 390 which urgingly presses the lower central portion of the lid 378 is disposed between the supporting arm 382 and the lid 378.

The vertical support shaft 388 is elevatable and rotatable within a longitudinal sleeve 392 which is secured to the upper portion of the storage tank 56. To enable the above movement of the shaft 388 relative to the sleeve 392, the upper portion of the support shaft 388 is formed with a thread 394 and also with a longitudinal slit 396. The longitudinal sleeve 392 does not mesh with the thread 394 and a first rotating ring 398 which is provided with a lever 400 is loosely but unrotatably mounted on the vertical support shaft 388 wherein the rotation of the shaft 388 is prevented by a key 402 which is disposed within the slit 396. A second rotating ring 404 attached with a wheel 406 is disposed over the first rotating ring 398 and is meshed with the upper threaded portion of the vertical support shaft 388. For the purpose of rotating the second rotating ring 404 at a stationary position, a lever means 408 which prevents the either upward or downward movement of the vertical shaft 388 is engaged with a recess 410 formed at the side of the second rotating ring 404. The proximal end of the lever 408 is fixedly secured to the top of the storage tank 56. To maintain the smooth elevation and rotation of the longitudinal sleeve 392, packings 412 are provided between the vertical shaft 388 and the longitudinal sleeve 392 to prevent the intrusion of dust. On the top of the vertical shaft 388, a stopper (shown in dotted line) which prevents the key 402 from loosening is mounted.

Since the lid means 378 of this invention is constructed in the above way, the rotation of the wheel 406 causes the downward movement of the vertical support shaft 388, and corresponding to the lowering of the shaft 388, the supporting arm 382 which becomes tightly in contact with the bottom surface of the ring seat 376 is also lowered away from the ring seat 376. Subsequently when the rotating ring 398 is rotated about 90 degrees by the manipulation of the lever 400, the vertical shaft 388 is also rotated at the same rotating angle whereby the lid means 378 which is supported by the supporting arm 382 is rotated horizontally, facilitating the opening of the charging inlet 64.

To close the charging inlet 64, the lid means 378 including operating means are all operated in a way opposite to the previous-mentioned way to open the charging inlet 64.

In the above closing operation, the upward elevation of the supporting arm 382 causes the compression of the central press means 390 after the lid 378 comes into contact with the ring seat 376, whereby the lid means 378 can be pressed onto the entire periphery of the ring seat 376 with a uniform sealing pressure.

Figure 52:
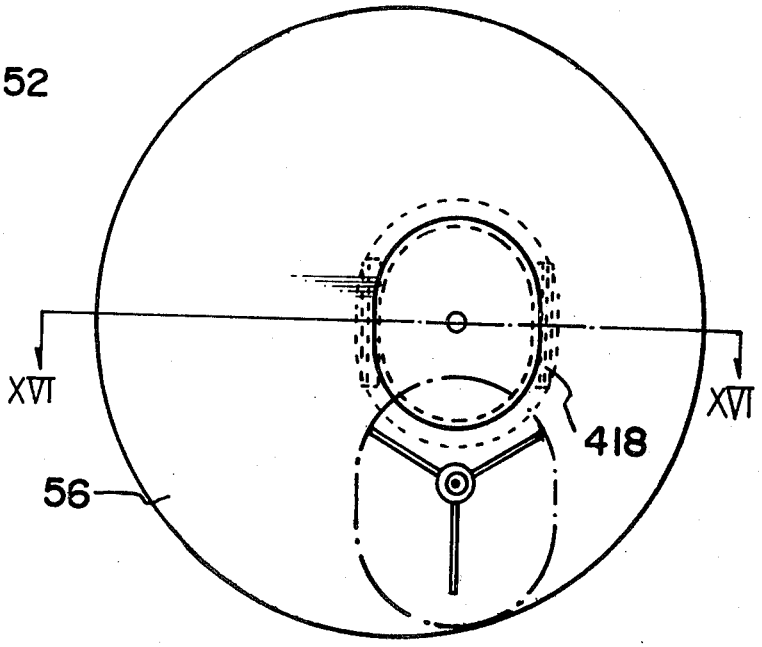
FIG. 52 is a plan view of the storage tank of the above apparatus showing especially the modification of the above lid means.
Figure 53:
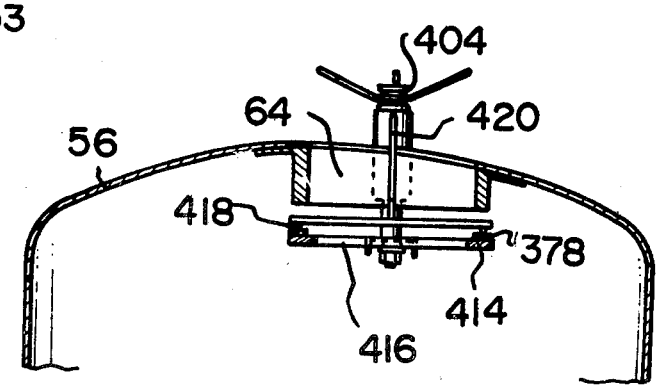
FIG. 53 is a longitudinal cross-sectional view of the above storage tank taken along the line VI—VI of FIG. 52.

The lid means 378 can also be constructed as shown in FIG. 52 and FIG. 53 such that the opening or closing of the charging inlet is conducted by the horizontal sliding movement of the lid means 378.

In the above construction, a supporting plate 414 has an area at least the same as the lid means 378 and this plate 414 is formed with an opening 416 which has substantially the same diameter as that of the charging inlet 64. The vertical movement of the lid 378 is conducted only by the second rotating ring 404. Accordingly, instead of the first rotating ring 398, guides 418 are provided on the supporting plate 414 on which the lid means 378 attached with a handle 420 is slidably mounted on the supporting plate 414. Therefore, after lowering the supporting plate 414 by rotating the second rotating ring 404, the lid means 378 is slid along the guides 418 so that the opening 416 formed to the supporting plate 414 comes into alignment with the charging inlet 64 and the charging inlet 64 opens.

As described above, the charging inlet 64 of the storage tank 56 is opened or closed by moving the lid 378 horizontally. Furthermore in the above operation, the slight lowering of the lid means 378 is sufficient to facilitate the closing or opening of the charging inlet, whereby even when the storage tank 56 is almost entirely filled with refractory material with its level close to the top of the tank 56, the lid 378 is operable. Therefore, the total volume of the storage tank 56 can be utilized effectively as the material-storing portion of the tank 56 and accordingly, it becomes unnecessary to charge the refractory material into the storage tank 56 as frequently as in the past.

(7) Shooting Pipe

Figure 54:
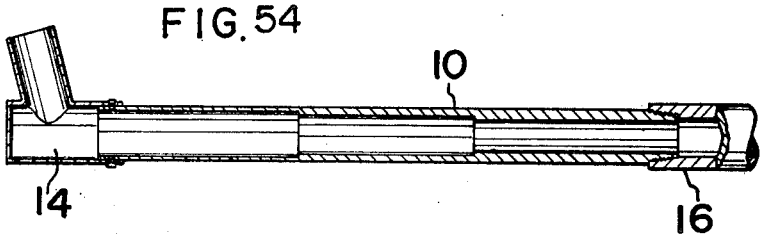
FIG. 54 is a cross-sectional view of a modified shooting pipe of this invention.
Figure 55:
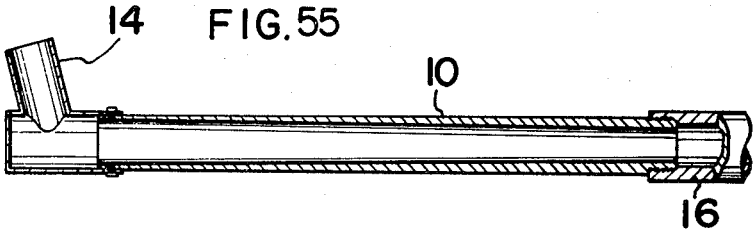
FIG. 55 is a cross-sectional view of another modified shooting pipe of this invention.

Several modifications of the shooting pipe can be considered in this invention. One modification is shown in FIG. 54 and FIG. 55 wherein the thickness of the shooting pipe 8 is reduced toward the extremity thereof where the spray nozzle 14 is provided.

Due to the above construction, the bending moment exerted along the entire length of the shooting pipe 8 by its own weight and by the weight of the refractory material which passes through the pipe 8 shows a low value at the distal extremity of the shooting pipe 8 and a high value at the proximal end of the shooting pipe 8.

Therefore, the entire weight of the shooting pipe 8 can be reduced without incurring a substantial load on the distal end thereof. This implies that the distal end of the shooting pipe 8 is subject to only a small load and accordingly to a small bending moment and therefore the shooting pipe deflects only a little, so that the shooting pipe can be extended in a straight manner to the deepest portion of the furnace and can repair the furnace lining at that point with accuracy.

Figure 56:
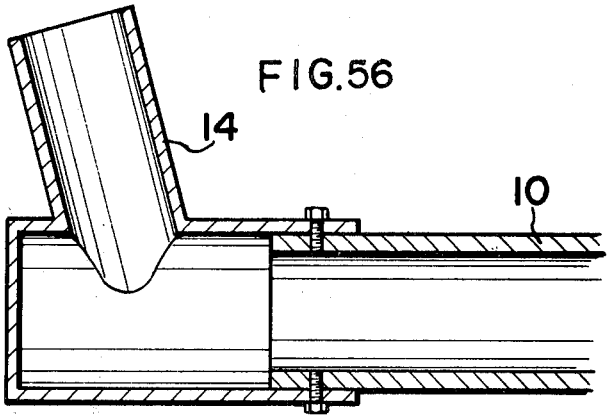
FIG. 56 is a cross-sectional view of still another modified shooting pipe of this invention.

Another modification of the shooting pipe is shown in FIG. 56.

In the drawing, the forward extremity of the shooting pipe 10 is snugly disposed within the rear opening of the spray nozzle 14. Due to the above construction, the contacting surface between the spray nozzle 14 and the shooting pipe 10 is no longer subject to the friction wear incurred by the flow of refractory material and furthermore since the inner diameter of the spray nozzle 14 is larger than that of the shooting pipe 8, the refractory material and the water which are unsatisfactorily mixed along the shooting pipe 8 can be perfectly within the spray nozzle 14 producing a satisfactory refractory material mixing.

What we claim is:

1. An apparatus for applying a refractory material onto the inner surface of a furnace comprising in combination:

a mobile transport car;

a spray pipe having a spray nozzle at one end thereof for spraying refractory material onto the inner surface of a furnace and adapted to receive the refractory material from a supply of the refractory material adjacent the other end thereof, said spray pipe comprising inner and outer pipes;

support means positioned on said mobile transport car pivotably supporting said spray pipe;

storage means mounted on said mobile transport car for storing at least a supply of refractory material therein, said storage means comprising a first tank for the storage of refractory material and a second tank for storage of water;

said outer pipe including a pipe cooling means which comprises an inlet opening formed in the wall of said outer pipe and a cooling water supply tube connected between said water storage tank and said inlet opening in said outer pipe;

means carried by said transport car for supplying the refractory material to said spray pipe from said storage means and for propelling the refractory material through said spray pipe and spray nozzle, said refractory material supply means comprising a flexible hose connected between the other end of said spray pipe and said refractory material storage tank, said flexible hose being connected at said other end of said spray pipe to said inner pipe;

a water outlet formed in said outer pipe and a warm water return tube connected between the water outlet of said outer pipe and said flexible hose; and a selected number of water-regulating means each of which includes an orifice plate, said water-regulating means being disposed in parallel relation at an intermediate location in said warm water return tube, and each of said water-regulating means including a solenoid valve adapted to selectively control the flow of water through the associated orifice plate to thereby provide control of water warmed by said cooling means to said flexible hose supplying refractory material to said spray pipe.

2. Apparatus according to claim 1, wherein each of said orifice plates is provided with a different number of orifices.

3. Apparatus according to claim 1, wherein each of said orifice plates is provided with orifices of different sizes.

4. Apparatus according to claim 1, wherein each of said orifice plates has a different number of orifices of the same size.

* * * * *